US010012456B2

(12) United States Patent
Withey

(10) Patent No.: US 10,012,456 B2
(45) **Date of Patent: *Jul. 3, 2018**

(54) FIREARM HAVING A DUAL CAM, COCK ON CLOSE BOLT ACTION AND A LOW CREEP SEAR AND STEP TRIGGER ASSEMBLY

(71) Applicant: Savage Arms, Inc., Westfield, MA (US)

(72) Inventor: Michael Withey, Belchertown, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/600,033

(22) Filed: May 19, 2017

(65) Prior Publication Data

US 2017/0254606 A1 Sep. 7, 2017

Related U.S. Application Data

(63) Continuation of application No. 14/316,426, filed on Jun. 26, 2014, now Pat. No. 9,658,007.

(60) Provisional application No. 61/973,808, filed on Apr. 1, 2014, provisional application No. 61/973,242, filed on Mar. 31, 2014, provisional application No. 61/927,222, filed on Jan. 14, 2014, provisional application No. 61/839,420, filed on Jun. 26, 2013.

(51) Int. Cl.

| | |
|---|---|
| ***F41A 3/22*** | (2006.01) |
| ***F41A 17/52*** | (2006.01) |
| ***F41A 3/42*** | (2006.01) |
| ***F41A 17/62*** | (2006.01) |
| ***F41A 21/48*** | (2006.01) |
| ***F41A 19/30*** | (2006.01) |
| ***F41A 19/16*** | (2006.01) |
| ***F41A 17/56*** | (2006.01) |

(52) U.S. Cl.

CPC ..... *F41A 3/22* (2013.01); *F41A 3/42* (2013.01); *F41A 17/52* (2013.01); *F41A 17/56* (2013.01); *F41A 17/62* (2013.01); *F41A 19/16* (2013.01); *F41A 19/30* (2013.01); *F41A 21/485* (2013.01)

(58) Field of Classification Search

CPC ..... F41A 3/22; F41A 3/24; F41A 19/34

See application file for complete search history.

(56) References Cited

U.S. PATENT DOCUMENTS

| | | | |
|---|---|---|---|
| 2,191,521 A | 2/1940 | Crockett | |
| 2,941,449 A | 6/1960 | Reed | |

(Continued)

FOREIGN PATENT DOCUMENTS

| | | | |
|---|---|---|---|
| DE | 1196547 | 6/1962 | |
| FR | 3020870 A1 * | 11/2015 | ..... F41A 3/22 |

(Continued)

*Primary Examiner* — Stephen Johnson

(74) *Attorney, Agent, or Firm* — Christensen, Fonder, Dardi & Herbert PLLC

(57) ABSTRACT

A bolt action firearm that cocks the firing pin upon closing the bolt and includes a cam pin for a high velocity rimfire cartridge. In one embodiment, actuating the main spring while closing the bolt, instead of while opening the bolt, provides added safety against misfiring. A safety system is provided for the trigger mechanism and a robust connecting system for the stock.

19 Claims, 31 Drawing Sheets

(56) References Cited

U.S. PATENT DOCUMENTS

| | | | | |
|---|---|---|---|---|
| 3,005,279 | A | 10/1961 | Brewer | |
| 3,330,061 | A * | 7/1967 | Koon, Jr. | F41A 3/22 42/16 |
| 3,713,363 | A | 1/1973 | Hurlemann | |
| 4,398,448 | A | 8/1983 | LaFever | |
| 4,454,672 | A | 6/1984 | Timari | |
| 5,915,934 | A | 6/1999 | Knight et al. | |
| 6,393,961 | B1 | 5/2002 | Ockenfuss | |
| 6,553,706 | B1 | 4/2003 | Gancarz et al. | |
| 9,605,917 | B2 * | 3/2017 | Withey | F41A 3/22 |
| 9,658,007 | B2 * | 5/2017 | Withey | F41A 3/22 |
| 2007/0245615 | A1 | 10/2007 | Karagias | |
| 2010/0281734 | A1 | 11/2010 | Rousseau et al. | |

FOREIGN PATENT DOCUMENTS

| | | |
|---|---|---|
| GB | 17373 | 5/1914 |
| WO | 2012/138305 A1 | 10/2012 |

* cited by examiner

FIREARM HAVING A DUAL CAM, COCK ON CLOSE BOLT ACTION AND A LOW CREEP SEAR AND STEP TRIGGER ASSEMBLY

RELATED APPLICATIONS

This patent application is a continuation of U.S. patent application Ser. No. 14/316,426, filed Jun. 26, 2014, now U.S. Pat. No. 9,658,007, which claims the benefit of U.S. Provisional Patent Application No. 61/973,808, filed Apr. 1, 2014, U.S. Provisional Patent Application No. 61/973,242, filed Mar. 31, 2014, U.S. Provisional Patent Application No. 61/927,222, filed Jan. 14, 2014, and U.S. Provisional Patent Application No. 61/839,420, filed Jun. 26, 2013, the disclosures of which are hereby incorporated by reference herein in their entirety.

BACKGROUND OF THE DISCLOSURE

Firearms that shoot small caliber rimfire cartridges enjoy great popularity because the cost of the firearm and attendant ammunition cost less than center fire firearms. Rimfire cartridges are typically on the lower end of kinetic energy because the velocity of the projectile is generally about 1100 feet per second or less. The lower projectile velocities have historically prevented small caliber rimfire cartridges from being used for anything but small game and at ranges under 100 yards.

Attempts to increase the speed of small caliber projectiles has been limited by both the bullet casing metal thicknesses as well as problems associated with firing thicker bullet casings. Thicker bullet casings require a heavier main spring for discharging the cartridge. Because of the need for a heavier main spring, the uplift force required to operate the bolt can be prohibitive. In addition, the heavier main spring produces significant drag as the user rotates the bolt handle to compress the main spring. As a result, the commercial success for such firearms and ammunition has been limited.

Also, because conventional small caliber rimfire firearms are not used for distances greater than about 100 yards, there has been little interest in developing higher quality trigger mechanisms suitable for longer distance shooting. Triggers for firearms must strike a compromise between ease of use and safety. Triggers utilized in competition firearms eliminate or reduce trigger creep by reducing the amount of sear engagement. As used herein, the term "creep" generally refers to the distance that a trigger will travel, or must be pulled, before the sear is engaged and dropped, thus permitting the main spring and firing pin to discharge the firearm. In addition, the "feel" of the trigger may be improved by polishing the engaging surfaces of the sear and the trigger. However, polishing does not reduce the amount of trigger creep, just the "feel" of the trigger creep. On the other hand, a reduction in the amount of sear engagement results in a perceived better trigger pull. For example, a trigger having about 0.015 inches of engagement would be considered by most shooters to be a better trigger than a trigger having about 0.025 inches of engagement.

An engagement between the sear and the trigger of greater than about 0.020 inches generally results in a trigger that is safe from accidental firing during an impact event (e.g., jarring or dropping the firearm), but the trigger is also generally considered to be prohibitively heavy. Reducing the sear and trigger engagement to about 0.016 inches results in a more favorable trigger creep, but the firearm is more prone to accidental discharge in an impact event.

For rifles having a heavy or high-force main spring, conventional small caliber bolt action firearms can be limited by the amount of force required to actuate the bolt.

Thus, a bolt action firearm having a low creep safety trigger and capable of actuating heavier main springs while, at the same time, providing improved trigger pull and which in one embodiment may be field adjustable by the user would be welcomed.

SUMMARY OF THE DISCLOSURE

Various embodiments of the disclosure a bolt action firearm that cocks the firing pin upon closing the bolt and includes a cam pin with dual heads. In one embodiment, actuating the main spring while closing the bolt, instead of while opening the bolt, more uniformly distributes the physical energy required by the user over the bolt actuation cycle. The dual heads of the cam pin provide symmetric reactive forces with dual cam slots, thereby preventing the cam pin from skewing or canting within the cam slots and the bolt assembly from skewing or canting within the bolt chamber. Also disclosed is a bolt action firearm with trigger mechanism and bolt particularly suited for high velocity rim fire ammunition. In one embodiment, the rifle is configured for .17 WSM ammunition.

With heavier rimfire cartridges, a substantially heavier main spring is required to reliably fire a cartridge. By way of non-limiting example, the heavier main spring can require two or three times more energy to compress than a standard rimfire spring. Because of the heavier main spring, the force required to disengage the bolt can be prohibitive using conventional designs. Standard bolts utilize a "cock-on-opening" design, wherein the firing mechanism is cocked upon disengagement of the bolt (i.e., upon the up stroke action on the bolt that initiates the extraction process). Various embodiments of the disclosure utilize a "cock-on-close" mechanism, wherein the main spring is engaged upon engagement of the bolt (i.e., upon the down stroke action on the bolt handle that readies the firearm for firing). Typically, the act of disengaging the bolt, which involves the user pulling upward and back on the bolt handle, is physically more demanding than the act of engaging the bolt, which involves the user pushing forward and down on the bolt handle. The cock-on-close aspect of the present disclosure incorporates the additional exertions required for compression of the main spring into the less demanding engagement of the bolt, making the overall sequence of physical acts more uniform.

Furthermore, a standard rimfire bolt normally utilizes a cam engaged with a single cam pin that projects to one side of the bolt. When the bolt is under an axial load, such as imposed by the main spring, the single cam pin imposes an asymmetrical reactive force between the bolt and the cam slot. There is a tendency for the asymmetrical force to cause the cam pin to skew or cant within the cam slot, which, for heavier main springs, can notably increase the drag imposed by the cam pin. Also, the asymmetric forces can also cause the bolt assembly to skew or cant within the bolt chamber.

For various embodiments of the present disclosure, the body of the bolt includes a cam pin that extends laterally (radially) therethrough, effectively creating dual pin heads that are diametrically opposed on the body of the bolt and that engage respective cam slots. Thus, when the user opens the bolt, the reactive forces of the bolt are substantially symmetrical, so that each of the dual pin heads does not skew or wind out of alignment, thereby allowing for a smoother action. As a result, the force required to operate the bolt during compression of the spring is reduced.

Structurally, the present disclosure is directed to a firearm particularly suited for high velocity rim fire ammunition, in particular .17 WSM ammunition. In one embodiment, the firearm includes: a receiver; a barrel attached to the receiver; and a dual cam bolt adapted to engage with the receiver, the dual cam bolt including a firing mechanism having a main spring and firing pin. In one embodiment, the firearm includes a trigger assembly having a stop lever, the trigger assembly including (i) a removable trigger bracket for the sear and trigger and (ii) a stop lever selectively movable between a blocking position and a non-blocking position, wherein the stop lever is finger actuated proximate to a finger portion of the trigger wherein the sear is rotatable to the non-blocking position to release the main spring and firing pin to discharge the firearm.

In one embodiment, the trigger bracket is tool-lessly attachable. The trigger bracket can be attachable without fasteners. The firearm can further include a trigger pull adjustment for the trigger, accessible by removal of the trigger bracket. In one embodiment, the trigger pull is user adjustable. The trigger pull adjustment can include a tool-less thumbwheel adjustment.

Also, in some embodiments, the thumbwheel adjustment is accessible to a user with the trigger assembly in an installed configuration within the receiver. In addition, the thumbwheel can include a detent to prevent unintentional movement of the trigger pull adjustment during use of the firearm.

In one embodiment, the bolt includes a bolt handle movable between a downward closed position and an upward open position, the bolt slidably movable within the receiver between a rearward position and a forward position. Also, in one embodiment, when the bolt is in the forward position, movement of the bolt handle to the downward closed position cocks the main spring and locks the bolt in a firing position.

In one embodiment, in the blocking position, the stop lever engages a notch in the sear.

The step can include an upper face and a lower face, separated by an engagement face. In one embodiment, the upper face and/or the lower face can be substantially planar and parallel to each other, with the engagement face being substantially perpendicular to the upper and lower faces. In various embodiments, with the stop lever in the blocking position, the sear is in primary engagement with the engagement face of the step portion. In one embodiment, the sear can contact the upper face and/or the lower face of the step. In addition, the trigger assembly can be selectively movable between an engaged configuration, wherein the trigger is in an engaged position, and a disengaged position, wherein the trigger is in a disengaged position. In one embodiment, the trigger is in the engaged position when the sear is in the blocking position with the lower horizontal surface of the trigger.

The trigger can also be in the disengaged position when the sear is in the non-blocking position. In one embodiment, the sear slides along the upper surface of the trigger between the engaged position and the disengaged position of the trigger.

In various embodiments, the firearm includes a safety bar being selectively movable between a safety-on position and a safety-off position. In one embodiment, when in the safety-on position, the safety bar engages an upper extension of the trigger.

In one embodiment, the main spring has potential energy to rotate the sear and discharge the firearm when the sear is moved to a non-blocking position.

In one embodiment, the stop lever is coaxial with the trigger. The stop lever can be nested within the trigger.

The firearm can also include a biasing element for maintaining the stop lever in a blocking position. The firearm can also include a sear return spring, and/or a trigger return spring.

These and other aspects of the present disclosure will become apparent to those skilled in the art after a reading of the following description of the preferred embodiment when considered with the drawings.

DETAILED DESCRIPTION OF THE DRAWINGS

Figure 1:
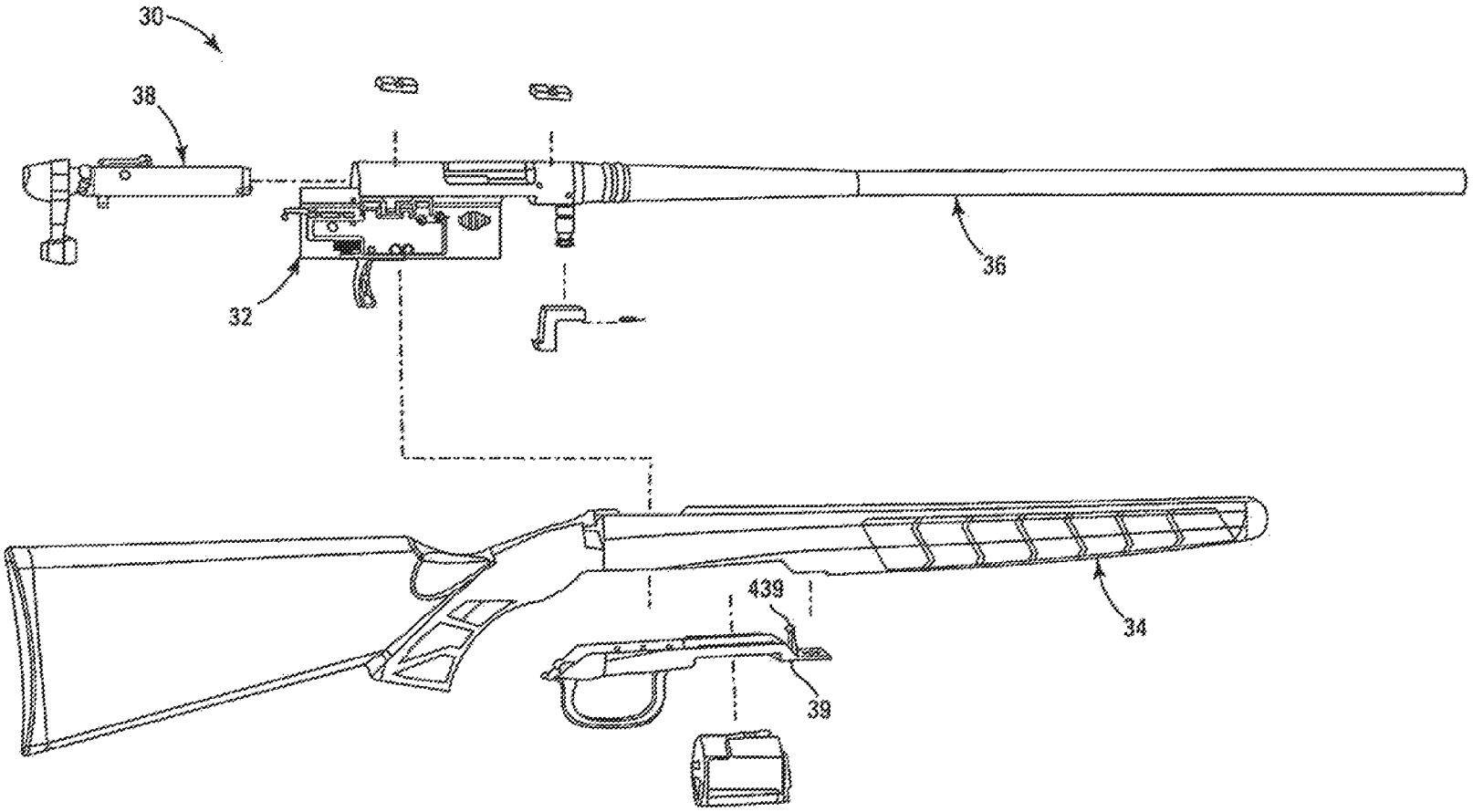
FIG. 1 is an exploded, side perspective view of a bolt action firearm having a low creep, trigger assembly, constructed according to the present disclosure.
Figure 2:
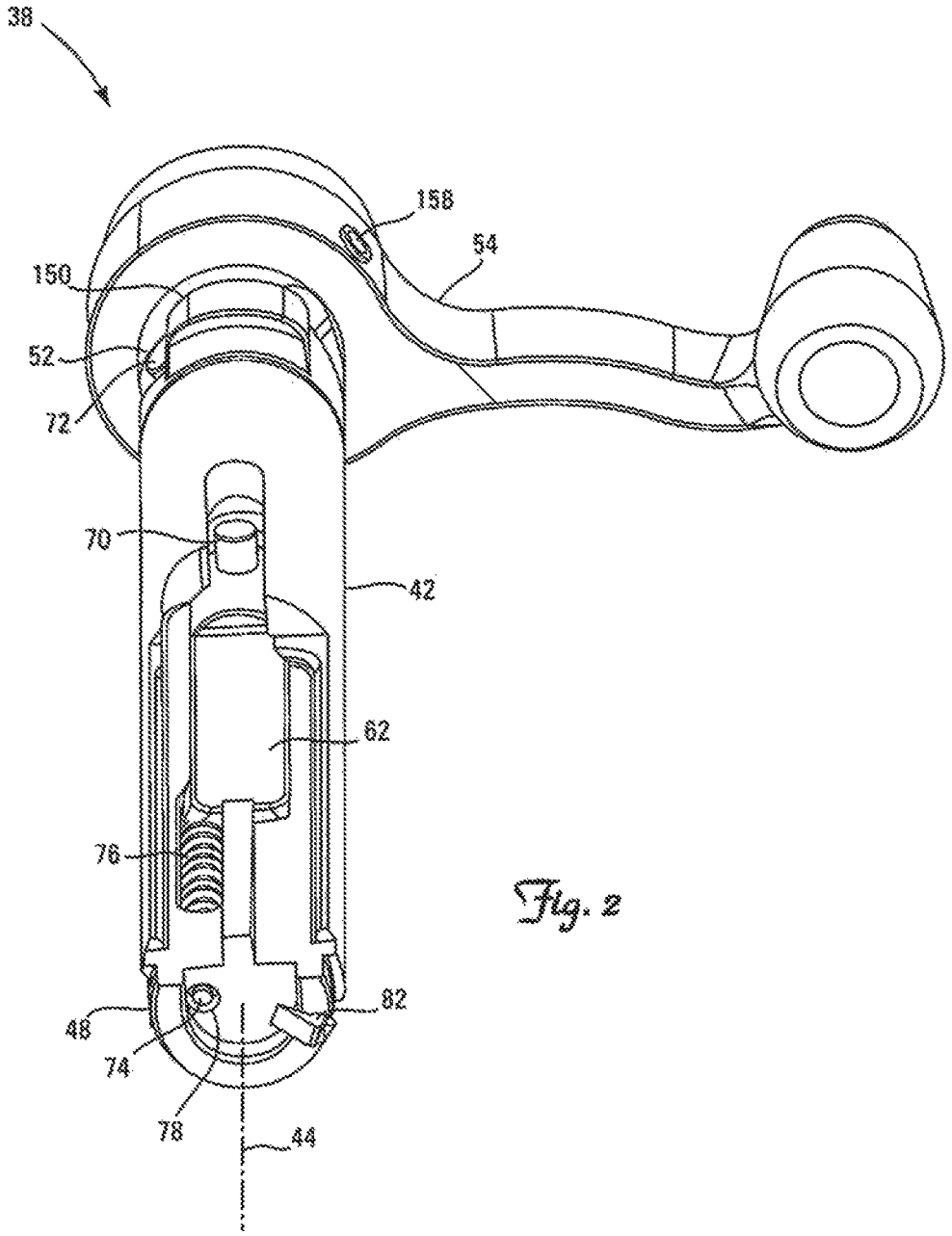
FIGS. 2 and 3 are bottom perspective views of a bolt assembly in an embodiment of the disclosure.

Referring to FIG. 1, an exploded, side perspective view of a firearm 30, such as a rifle or shotgun, is depicted in an embodiment of the disclosure. The firearm 30 is a bolt action firearm and can includes a low creep trigger assembly 32 installed therein. The firearm 30 further includes a receiver or stock 34, a barrel 36, and a dual cam, cock-on-close bolt assembly 38. For brevity, the dual cam, cock-on-close bolt assembly 38 is hereinafter referred to as "bolt assembly 38". The firearm can also include a trigger guard assembly 39.

Referring to FIGS. 2 through 7, the bolt assembly 38 is depicted in an embodiment of the disclosure. In the depicted embodiment, the bolt assembly 38 includes a main body 42, the main body 42 defining a central axis 44 that extends through a proximal end 46 and a distal end 48. The bolt assembly further includes a cam cylinder 52, a handle portion 54, and an end cap 56. The cam cylinder 52 is coupled to the proximal end of the main body 42. The handle portion 54 and the end cap 56 are coupled to the cam portion 52. A plunger 62, a main spring 64, and a spring retainer 66 are slidingly engaged within a center bore 68 that is defined within the main body 42. In one embodiment, a trigger pin 70 extends downward from the plunger 62. The plunger 62 is distal to the main spring 64, and main spring 64 is distal to the spring retainer 66. A cam pin 72 extends through the spring retainer 66, engaging the cam cylinder 52 on diametrically opposed sides of the cam cylinder 52. A firing pin 74 and a firing pin return spring 76 are disposed in a first off-center bore 78, the firing pin 74 being extendable through the distal end 48 of the main body 42. The firing pin 74 and firing pin return spring 76 can be substantially concentric about the off-center axis 122. In one embodiment, a proximal end 79 of the first off-center bore 78 is of larger diameter than a distal end 80 of the first off-center bore 78, with a shoulder 81 being defined at a transition therebetween for registration of the firing pin return spring 76. The firing pin can also include a flange portion 75 at a proximal end, against which a proximal end of the firing pin return spring 76 is registered.

In one embodiment, an extractor claw 82 is coupled to the distal end 48 of the main body 42. In one embodiment, the extractor claw 82 is biased by a spring loaded pin 84 that is disposed in a second off-center bore 86 formed in the main body. The spring loaded pin 84 also captures the extractor claw 82 within a lateral recess 88.

Figure 8:
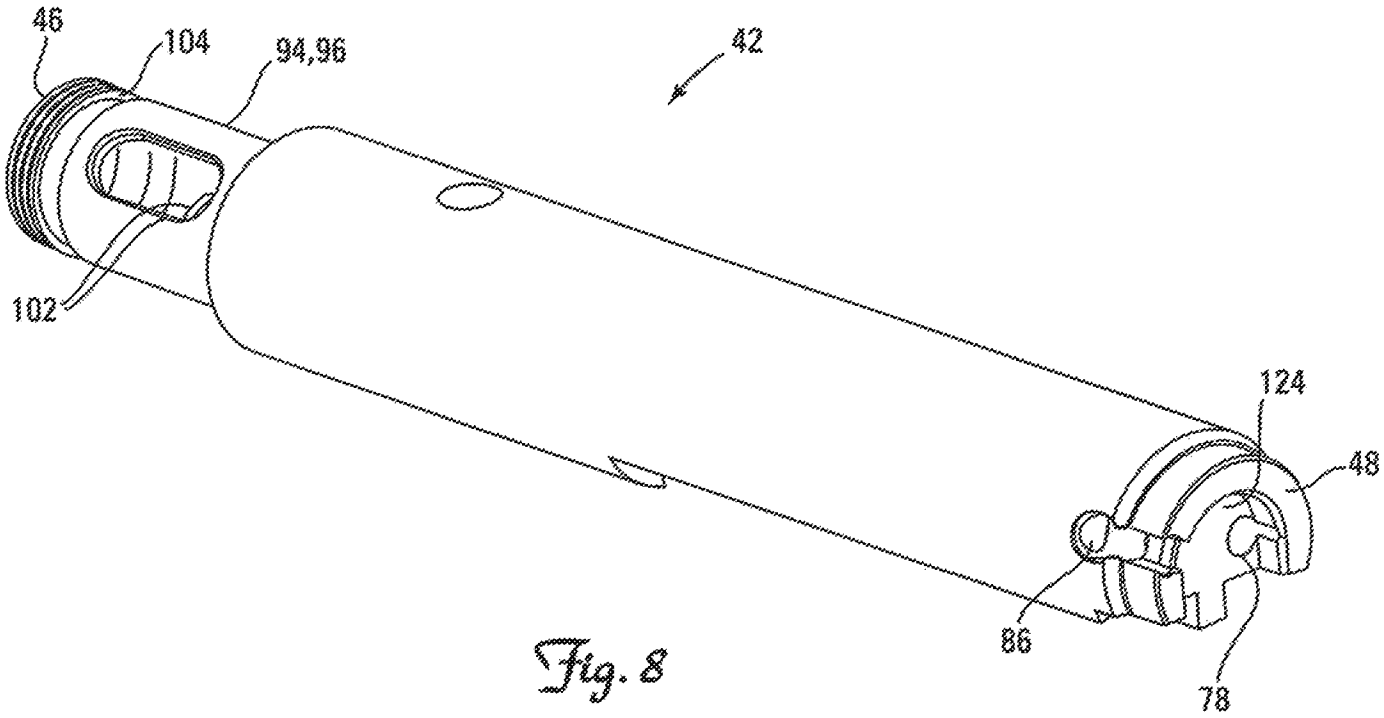
FIG. 8 is a front perspective view of a main body of the bolt assembly of FIG. 2 in an embodiment of the disclosure.
Figure 9:
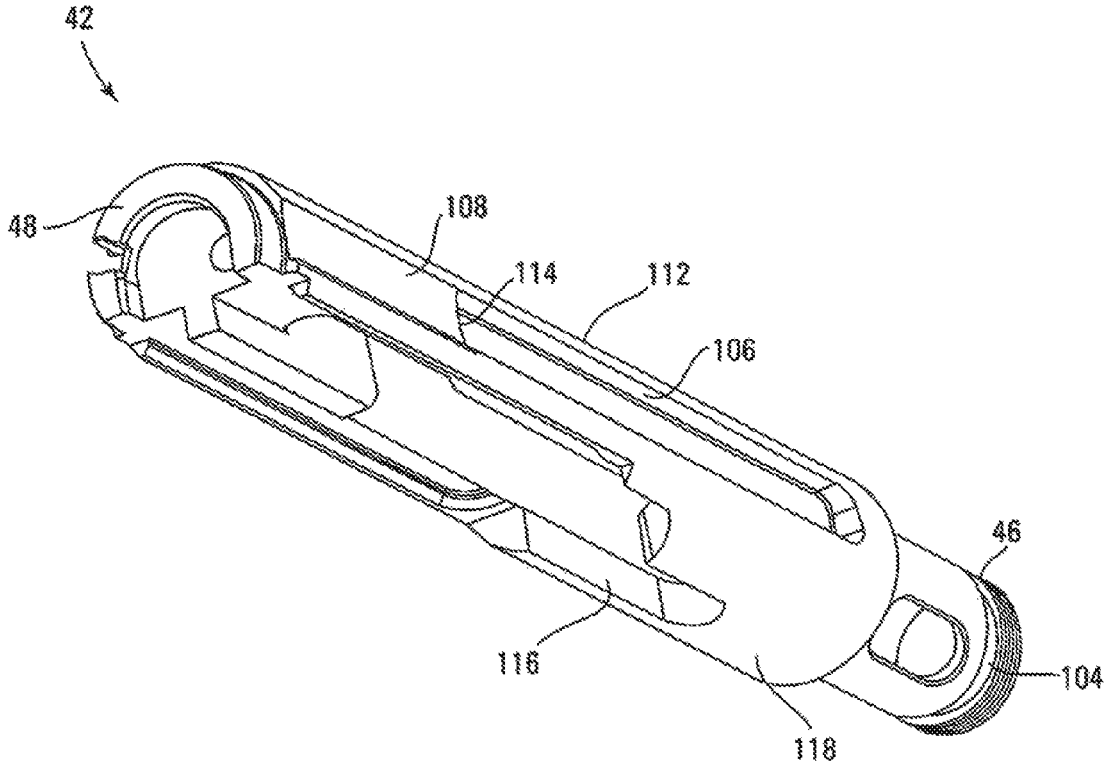
FIG. 9 is a rear bottom perspective view of the main body of FIG. 8.
Figure 10:
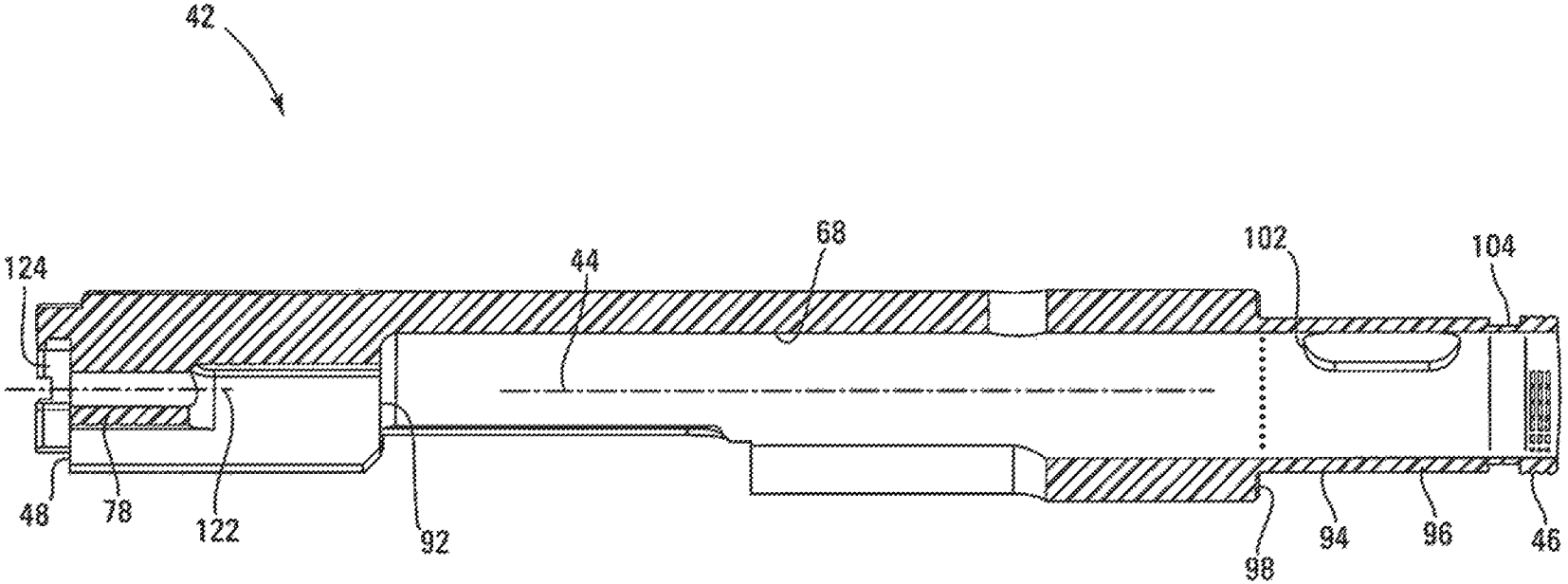
FIG. 10 is an elevation section view of the main body of FIG. 8.

Referring to FIGS. 8 through 10, the main body 42 of the bolt assembly 38 is depicted in isolation in an embodiment of the disclosure. In the depicted embodiment, the center bore 68 extends along the central axis 44 from the proximal end 46 partway into the main body 42 to define a distal boundary 92. The main body 42 includes a neck portion 94 of reduced diameter at the proximal end 46, the neck portion 94 and center bore 68 defining a cylindrical wall 96. The reduction in diameter also defines a shoulder portion 98 adjacent the neck portion 94. In one embodiment, a pair of diametrically opposed elongate through-slots 102 that extend parallel to the central axis 44 is also defined on the neck portion 94, each passing through the cylindrical wall 96 of the neck portion 94. In one embodiment, a tangential channel 104 is formed on the neck portion 94 near the proximal end 46 of the main body 42.

In one embodiment, the main body 42 also defines an elongate slot 106 that extends along a lateral face 108 of a mid portion 112 of the main body 42, the elongate slot 106 including a distal end 114. The main body can also define an open ended slot 116 on a bottom face 118 of the mid portion 112. The first off-center bore 78 of the main body 42 extends along an off-center axis 122 that is eccentric but parallel to the central axis 44, the first off-center bore 78 extending through the distal end 48 of the main body. A recess 124 can be formed in the distal end 48 of the main body 42 for engaging a cartridge therein.

Figure 4:
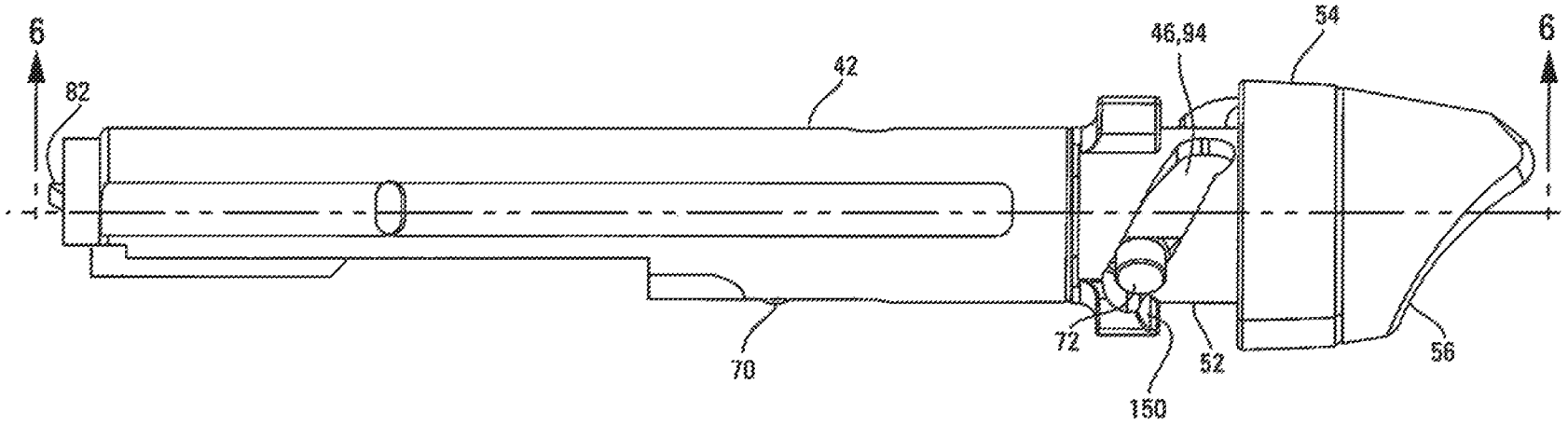
FIG. 4 is an elevation view of the bolt assembly of FIG. 2.
Figure 11:
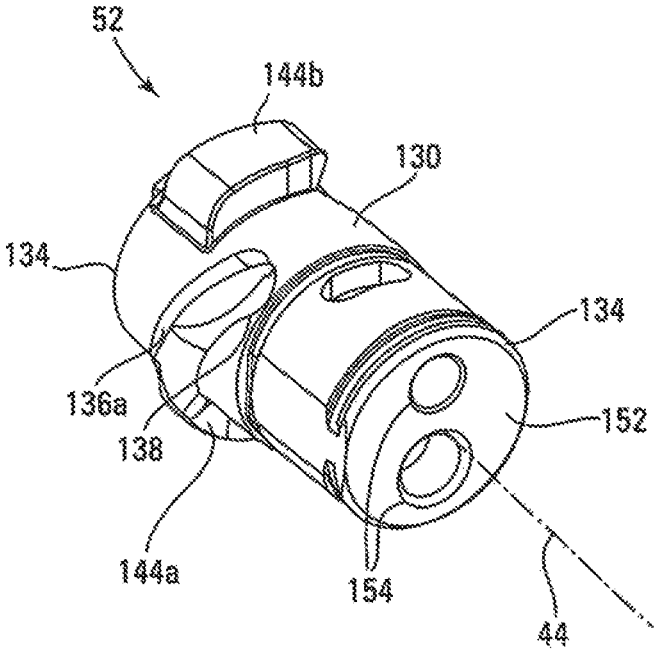
FIGS. 11 and 12 are perspective views of a cam cylinder in an embodiment of the disclosure.
Figure 12:
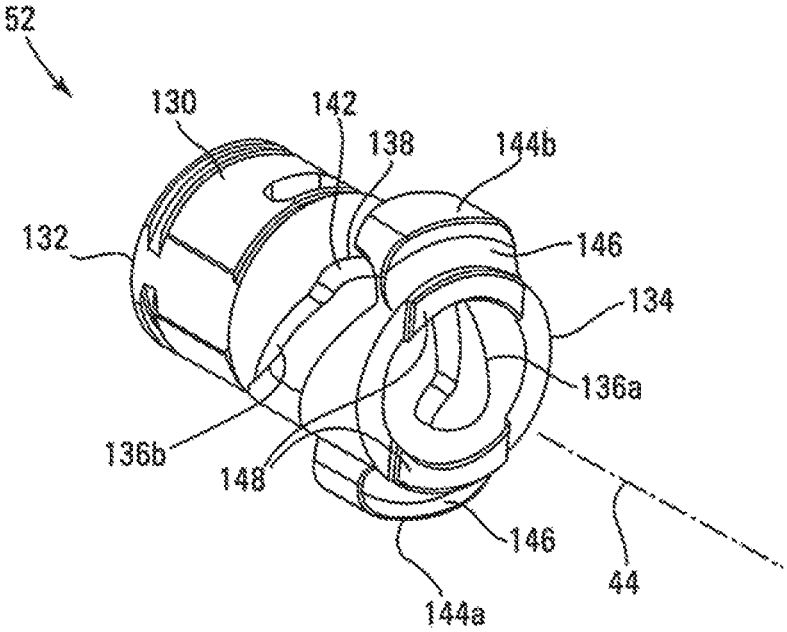

Referring to FIGS. 11 and 12, the cam cylinder 52 is depicted in an embodiment of the disclosure. The cam cylinder 52 includes a hollow cylindrical body 130 having a proximal end 132 and a distal end 134, the cylindrical body 130 being substantially concentric with the central axis 44. The cylindrical body 130 defines a pair of diametrically opposed cam slots 136 formed therethrough (referred to collectively and generically as cam slot(s) 136, and individually as cam slots 136*a* and 136*b*). The cam slots 136 mirror each other about the central axis 44. Each cam slot 136 defines a partial spiral about the central axis 44. In one embodiment, each cam slot includes enlargements 138 at the ends that define a registration surface 142 that extends proximally. In one embodiment, the cam cylinder 52 includes a pair of diametrically opposed outwardly extending tabs 144 (referred to collectively and generically as outwardly extending tab(s) 144 and individually as outwardly extending tabs 144*a* and 144*b*), extending radially outward proximate the distal end 134 of the cylindrical body 130. Each of the outwardly extending tab portions 144*a*, 144*b* can be characterized as having a proximal face 146. Also, in some embodiments, the outwardly extending tab portions 144 can include an inclined lead-in surface 150 (FIG. 4). In one embodiment, a pair of raised faces 148 can be defined on the distal end 134 of the hollow cylindrical body 130. The hollow cylindrical body 130 can include a plug portion 152 at the proximal end 132. The plug portion 152 can define apertures 154 that accommodate mounting the end cap 56 thereto. The cam cylinder 52 can also include an arcuate through-slot 156 that accommodates a set screw 158 (FIG. 2) in the mounting of the handle portion 54.

Figure 13:
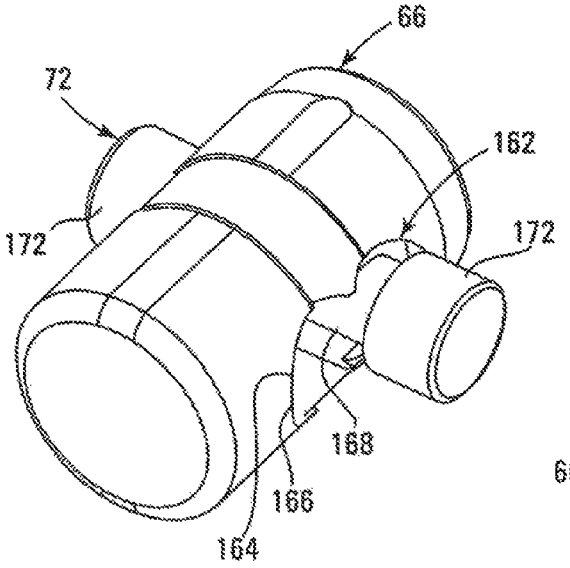
FIG. 13 is a perspective view of a spring retainer and cam pin assembly in an embodiment of the disclosure.
Figure 14:
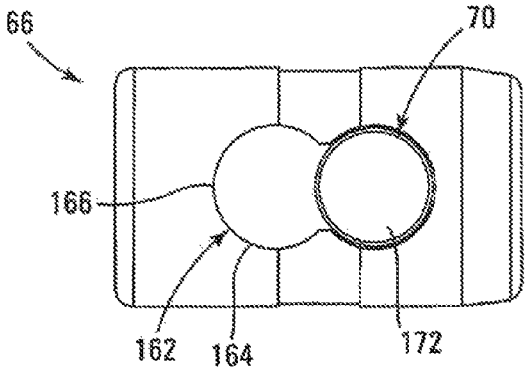
FIG. 14 is an elevation view of the spring retainer and cam pin assembly of FIG. 13.
Figure 15:
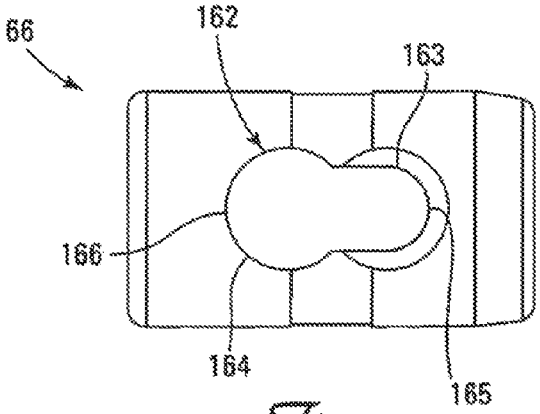
FIG. 15 is an elevation view of the spring retainer of FIG. 13 in isolation.

Referring to FIGS. 13 through 15, the spring retainer 66 and cam pin 72 is depicted in an embodiment of the disclosure. The spring retainer 66 can define a keyhole slot 162 that passes laterally through the spring retainer 66, the keyhole slot having a narrow slot portion 163 on a proximal end 165 thereof and an enlarged diameter 164 on a distal end 166 thereof. The cam pin 72 can include a shaft portion 168 and enlarged head portions 172.

To assemble, one of the enlarged head portions 172 of the cam pin 72 is inserted through the larger diameter portion 164 of the keyhole slot 162. Once the cam pin 72 is substantially laterally centered in the keyhole slot 162, the cam pin 72 can be set into the narrow slot portion 163 of the keyhole slot 162 that is proximal to the enlarged diameter 164. Once installed within the bolt assembly 38, the cam pin 72 can remain set in the proximal end 165 of the keyhole slot 162 because of the biasing force applied by the main spring 64. The enlarged head portions 172 limits the lateral displacement of the cam pin 72 within the narrow slot portion 163 during operation.

Figure 5:
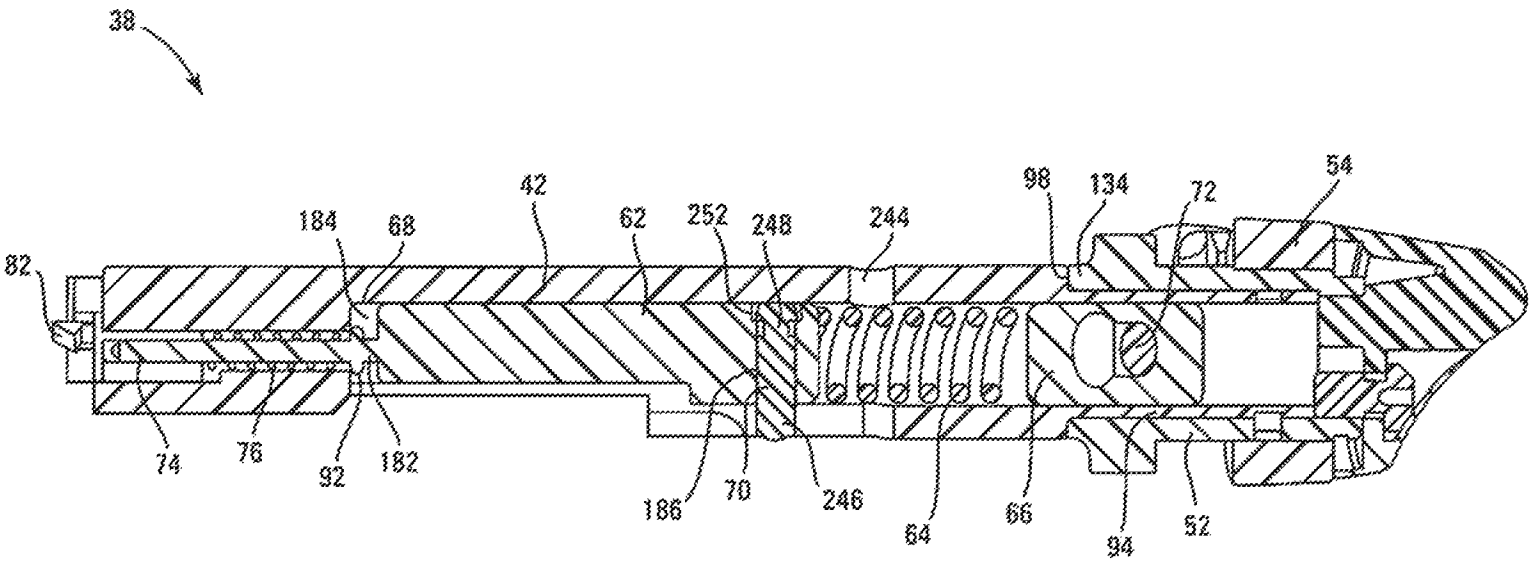
FIG. 5 is an elevation sectional view of the bolt assembly of FIG. 2.
Figures 6, 7:
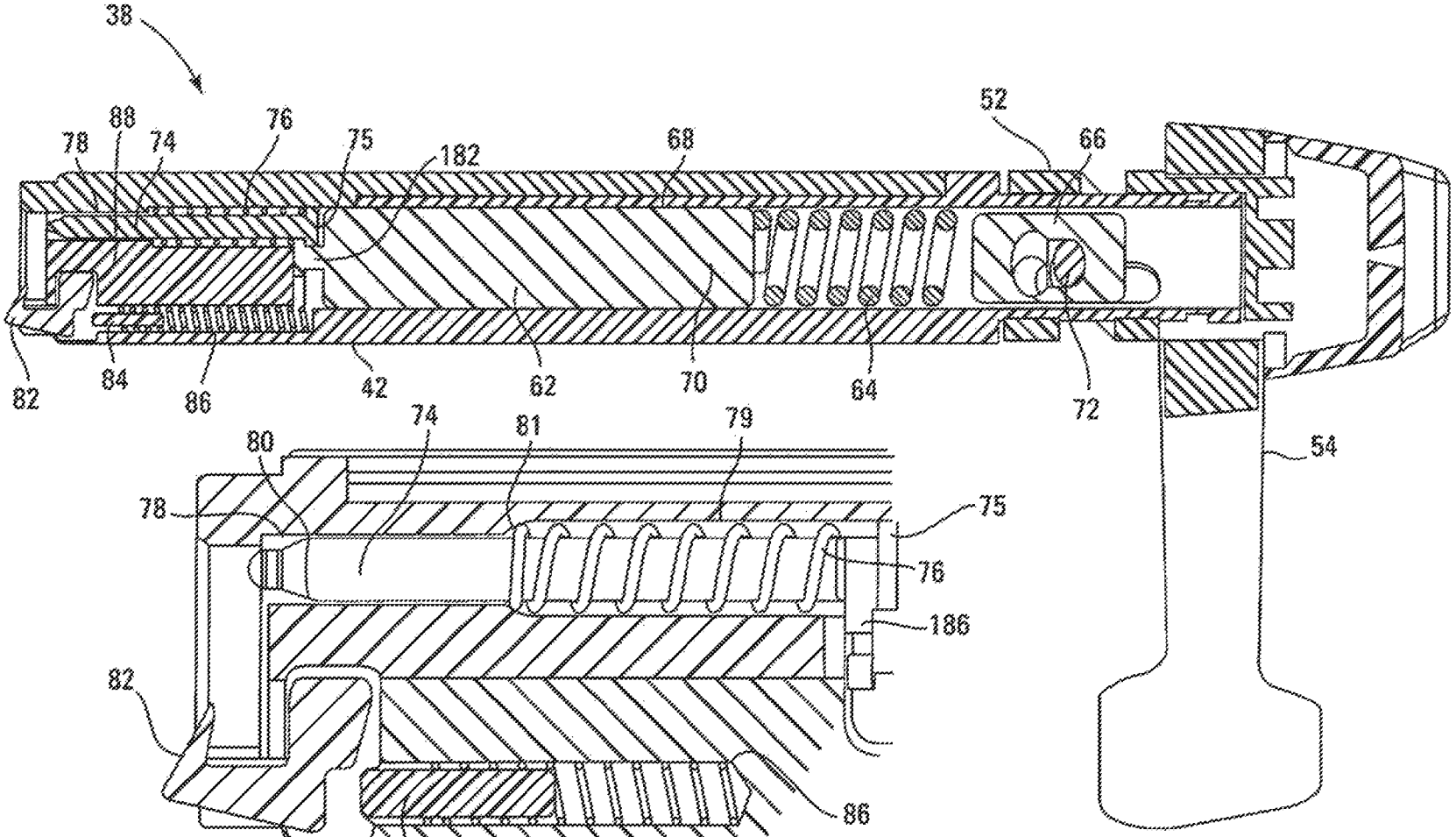
FIG. 6 is a bottom plan sectional view of the bolt assembly of FIG. 2.
FIG. 7 is an enlarged portion of FIG. 6.

Referring again to FIGS. 2 through 7, the plunger 62 can include a stop portion 182 on a distal end 184 thereof. The stop portion 182 contacts the distal boundary 92 of the center bore 68 when the plunger 62 is fully extended in the distal direction. In one embodiment, the stop portion defines a detent 186 (FIG. 7). In one embodiment, the detent 186 engages the flange 75 of the firing pin 74, thereby coupling the firing pin 74 to the plunger 62 so that the firing pin 74 follows the plunger 62. The plunger 62 can also define a trigger pin bore 186 within which the trigger pin 70 is mounted, the trigger pin 70 extending in a downward direction from the plunger 62.

Figure 16:
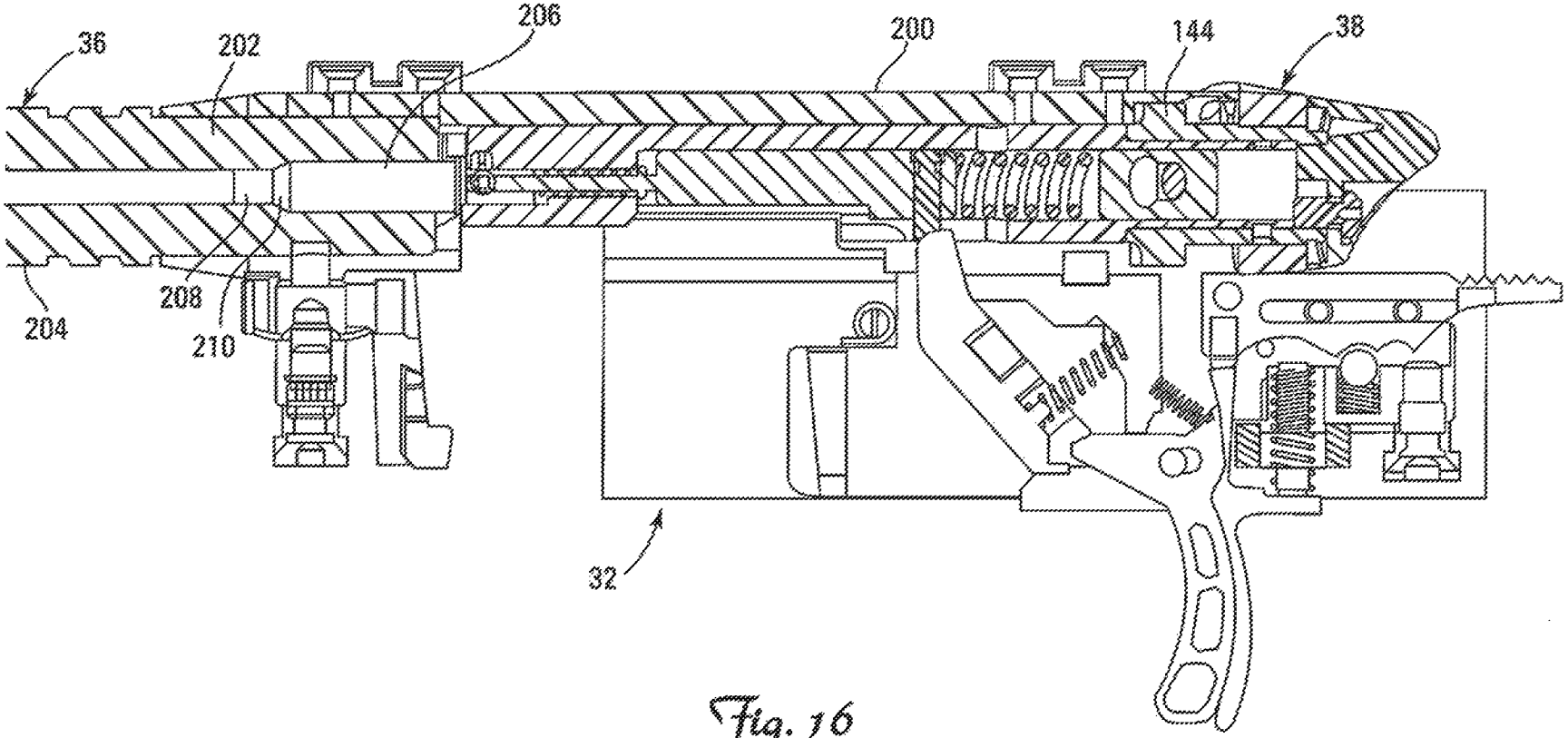
FIG. 16 is a sectional view of the firearm of FIG. 1 as assembled.
Figure 16A:
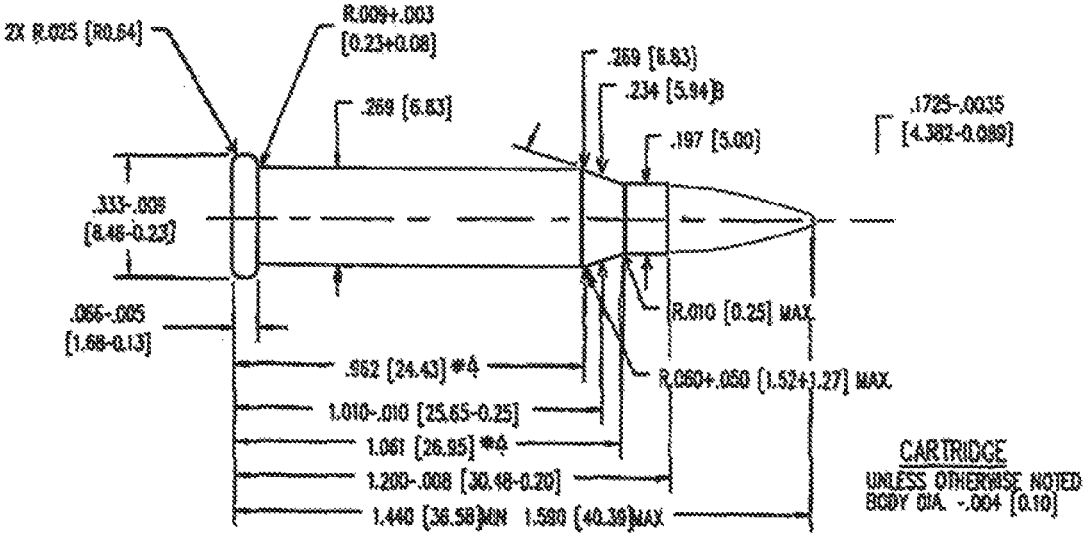
Fig. 16A Prior Art
FIG. 16A present the specification dimensions of a .17 WSM cartridge.

Referring to FIG. 16, an assembled view of the bolt assembly 38, barrel assembly 36, and trigger assembly 32 is depicted in an embodiment of the disclosure. In the depicted embodiment, the barrel assembly 36 includes a housing 200 attached to a proximal end 202 of a rifle barrel 204 having a cartridge or firing chamber 206. In various embodiments, the firing chamber 206 includes a reduced neck portion 208 and shoulder portion 210, suitable for accommodating shouldered cartridges. Non-limiting examples of the types of cartridges that the firing chamber 206 can be configured to accommodate include the .17 Winchester Super Magnum (WSM) and the .17 Hornady Magnum Rimfire (HMR). Standard specification dimensions of the .17 WSM cartridge is depicted in FIG. 16A.

Figure 17:
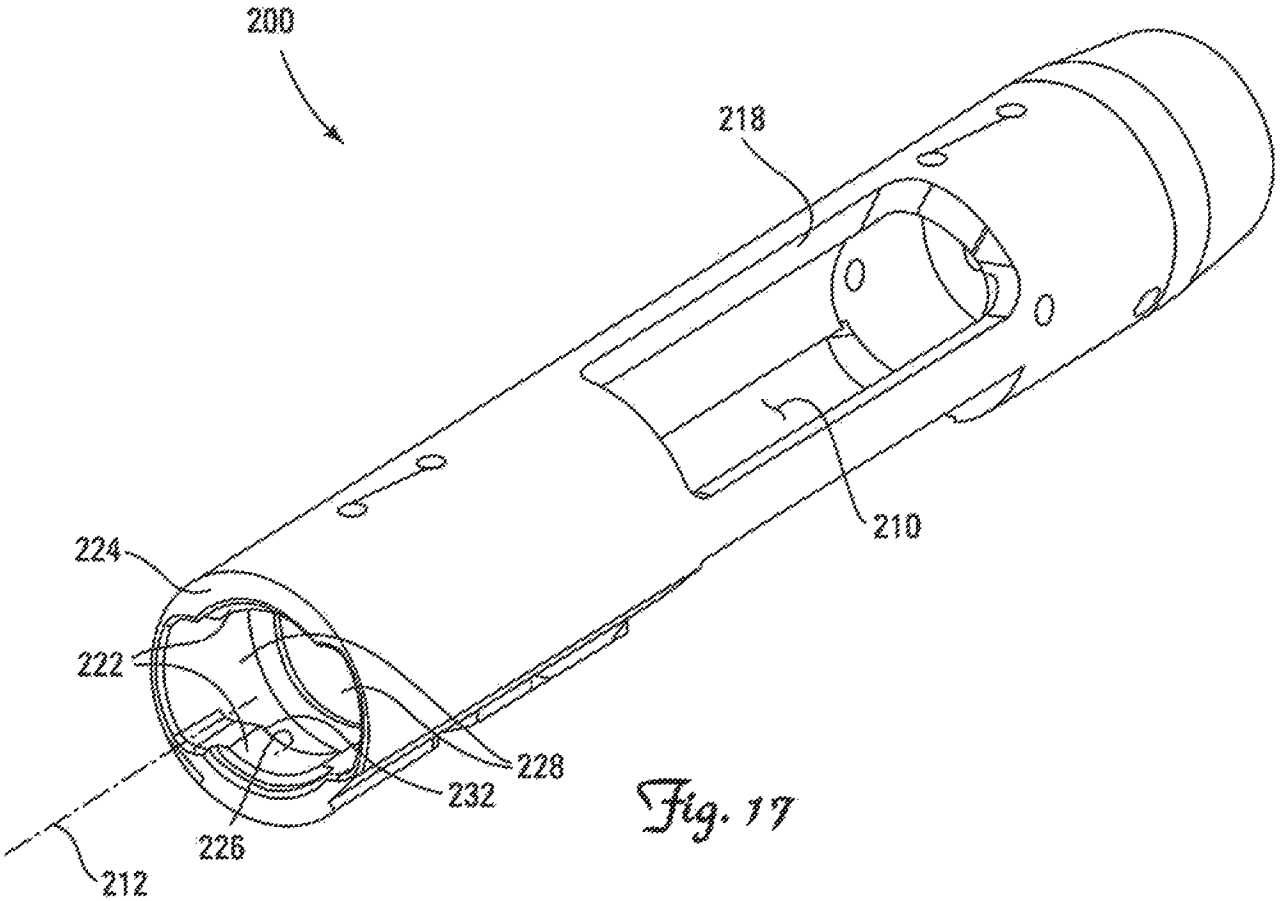
FIG. 17 is a rear perspective view of a housing in an embodiment of the disclosure.
Figure 18:
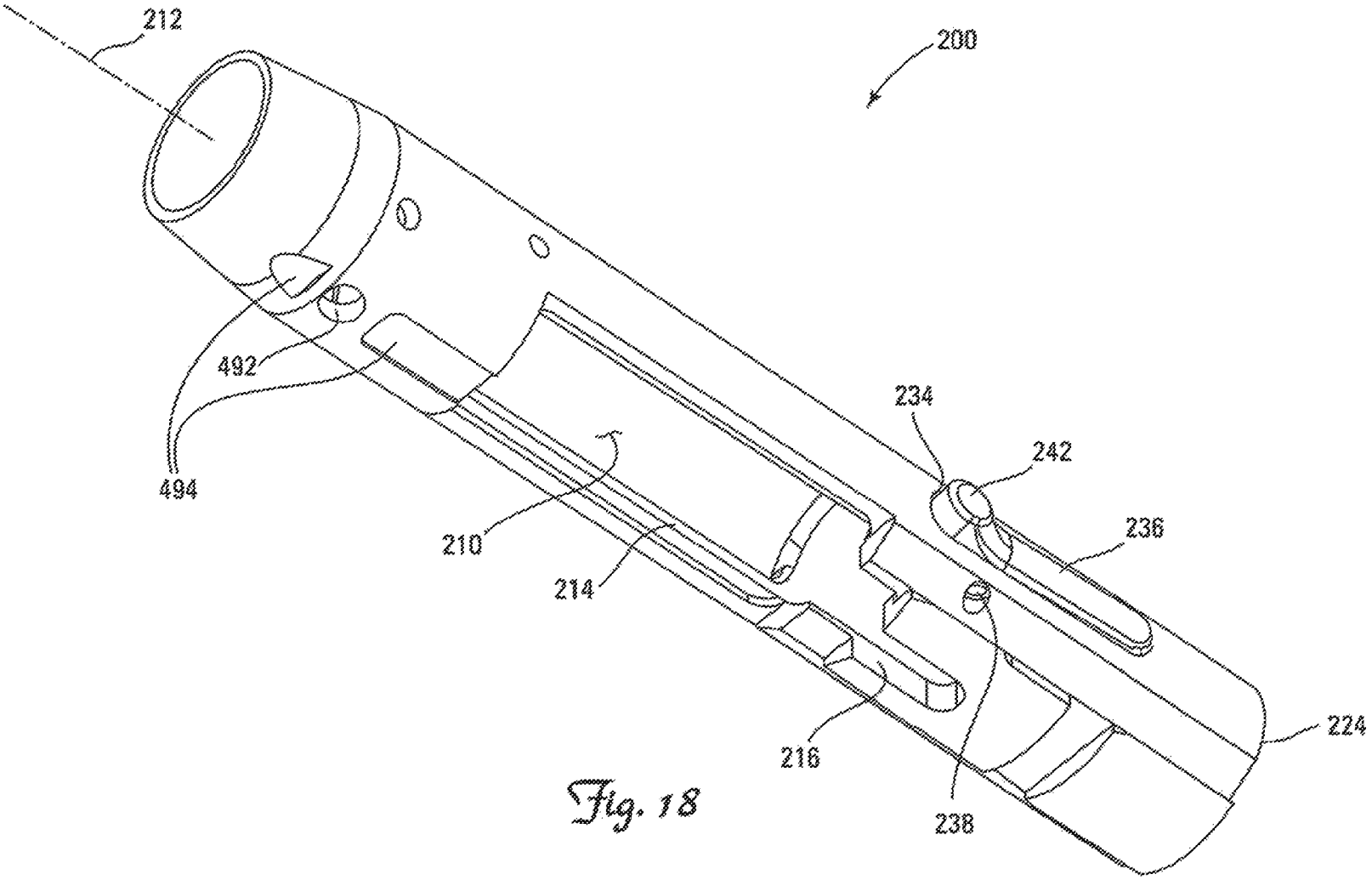
FIG. 18 is a bottom perspective view of the housing of FIG. 17.

Referring to FIGS. 17 and 18, the housing 200 is depicted in isolation in an embodiment of the disclosure. The housing 200 can define a generally cylindrical chamber 210 about an actuation axis 212. In one embodiment, the central axis 44 of the bolt assembly 38 is substantially concentric with the actuation axis 212 when the firearm 30 is fully assembled. In one embodiment, an access slot 214 is formed on a bottom side of the housing 200. In various embodiments, the housing 200 includes an open ended slot 216 that aligns with the open ended slot 116 and the trigger pin 70 of the bolt assembly 38. The housing can also include a through slot 218 through which spent shell casings can be ejected.

In one embodiment, the housing 200 includes inwardly extending retaining tab portions 222 that are disposed on a proximal end thereof 224. The inwardly extending retaining tab portions 222 are each characterized as having a distal face 226, can be of equal tangential dimension, and can be diametrically opposed, thereby defining tangential gaps 228 therebetween. The tangential gaps 228 complement and are of slightly larger tangential dimension than the outwardly extending tab portions 144 of the cam cylinder 52 of the bolt assembly 38, so that the outwardly extending tab portions 144 can be readily translated fore and aft of the inwardly extending retaining tab portions 222. Like the outwardly extending tab portions 144, the inwardly extending retaining tab portions 222 can include inclined lead-in surfaces 232.

In one embodiment, the housing 200 can further include a lateral, elongate slot 234 to which a release clip 236 (also depicted in FIG. 18) is mounted. The release clip 236 is rotatably mounted to a pivot 238 and includes a push button 242 on one end and a detent (not depicted) on the other end, the detent extending radially inward into the housing for engaging the elongate slot 106 that extends along the lateral face 108 of the mid portion 112 of the main body 42. The release clip 236 can be biased so that the detent is engaged within the elongate slot 106, which catches the distal end 114 of the elongate slot 106 when the bolt assembly 38 is drawn to an extreme proximal position, thereby preventing the bolt assembly 38 from being inadvertently removed from the housing 200 during operation. To intentionally extract the bolt assembly 38 from the housing 200, the push button 242 is depressed, thereby rotating the detent out of the elongate slot 106, enabling the bolt assembly 38 to be extracted from the proximal end 224 of the housing 200.

In assembly, for the depicted embodiments, the plunger 62 is placed within the center bore 68 of the main body 42 with the stop portion 182 oriented in the distal direction. The plunger 62 is translated within the center bore 68 of the main body 42 until the trigger pin bore 186 is aligned with a pin access aperture 244 on the main body 42. The trigger pin 70 is then inserted through the access aperture 244 and registered within the trigger pin bore 186 so that none of the trigger pin 70 extends above the plunger 62 while a portion 246 of the trigger pin 70 extends below the plunger 62. In one embodiment, a head 248 of the trigger pin 74 registers on a shoulder 252 formed in the trigger pin bore 186 (FIG. 5). The main spring 64 is then inserted into the center bore 68.

The cam cylinder 52 is slid over the neck portion 94 of the main body 42 of the bolt assembly 38, the distal end 134 of the cam cylinder 52 being brought into contact with the shoulder portion 98 adjacent the neck portion 94. The cam cylinder 52 is rotated about the neck portion 94 so that the cam slots 136 of the cam cylinder 52 and the elongate through-slots 102 of the neck portion 94 overlap. The spring retainer 66 is inserted into the center bore 68 so that the enlarged diameter 164 of the keyhole slot 162 is distal to the narrower end 163. The spring retainer 66 is oriented within the neck portion 94 so that the enlarged diameter 164 of the keyhole slot 162 is aligned with the overlapping portions of the cam slots 136 and the elongate through-slots 102. The cam pin 72 is then inserted through the overlapping portions of the cam slots 136 and elongate through-slots 102, and through the enlarged diameter 164 of the keyhole slot 162.

In various embodiments, the main spring 64, plunger 62, and spring retainer 66 are dimensioned so that, during the alignment of the keyhole slot 162 with the cam slots 136 and the elongate through-slots 102, the main spring 64 is compressed. Accordingly, the main spring 64 exerts a force on the spring retainer 66 and the cam cylinder 52 when the bolt assembly 38 is assembled. In one embodiment, the cam cylinder 52 is retained the on the neck portion 94 against this force by the set screw 158 that passes laterally through the cam cylinder and extends into the tangential channel 104 of the neck portion 94. In one embodiment, the set screw 158 also functions to mount the handle 54 to the cam cylinder 52.

The compression of the main spring 64 biases the plunger 62 within the cylindrical chamber 210 of the housing so that the trigger pin 70 is always distal to the pin access aperture 244 once assembled, so that the trigger pin 70 will not align with the pin access aperture 244 during operation of the firearm 30. The compression of the main spring 64 also biases the cam pin 72 proximally into the narrower end 163 of the keyhole slot 162, so that the cam pin 72 does not move distally into the enlarged diameter 164 of the keyhole slot 162. In one embodiment, the biasing force generated by the main spring 64 as assembled also biases the enlarged head portions 172 of the cam pin 72 proximally into the enlargements 138 of the cam slots 136 when the cam pin is at either end of the cam slots 136. The biasing functions to provide seating of the cam pin 72 against the registration surfaces 142 of the enlargements 138, thereby causing a preference for the bolt assembly 38 to be in the fully closed or the fully open positions.

During operation, the bolt assembly 38 is translated forward within the housing chamber 200 so that the outwardly extending tab portions 144 of the bolt assembly 38 pass through the tangential gaps 228 at the proximal end 224 of the housing 200, with the handle 54 in the uncocked position. In the forward-most translated position, the bolt assembly 38 registers against the firing chamber 206. In one embodiment, the trigger pin 70 comes into contact with a sear 256 that extends through the access slot 214 of the housing 200.

The closing rotation of the handle 54 causes the cam cylinder 52 to rotate about the neck portion 94 of the main body 42 of the bolt assembly 38, so that the proximal faces 146 of the outwardly extending tab portions 144 of the cam cylinder 52 are engaged with the distal faces 226 of the inwardly extending retaining tab portions 222 of the housing 200. When present, the lead-ins 150, 232 of the outwardly extending tabs 144 and the inwardly extending retaining tabs 222 assist in the transition of the engagement.

Figure 19:
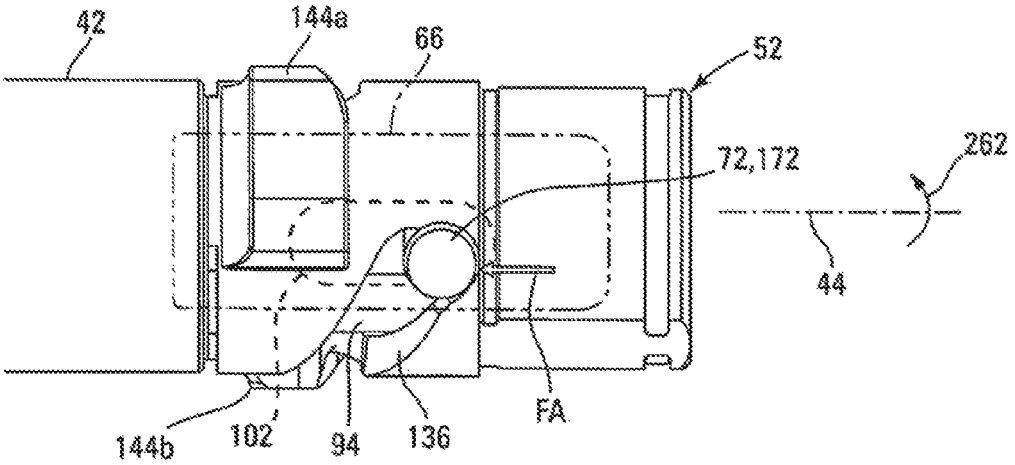
FIGS. 19 and 20 depict the cam cylinder, main body, spring retainer, and cam pin of FIG. 2 in operation in an embodiment of the disclosure.
Figure 20:
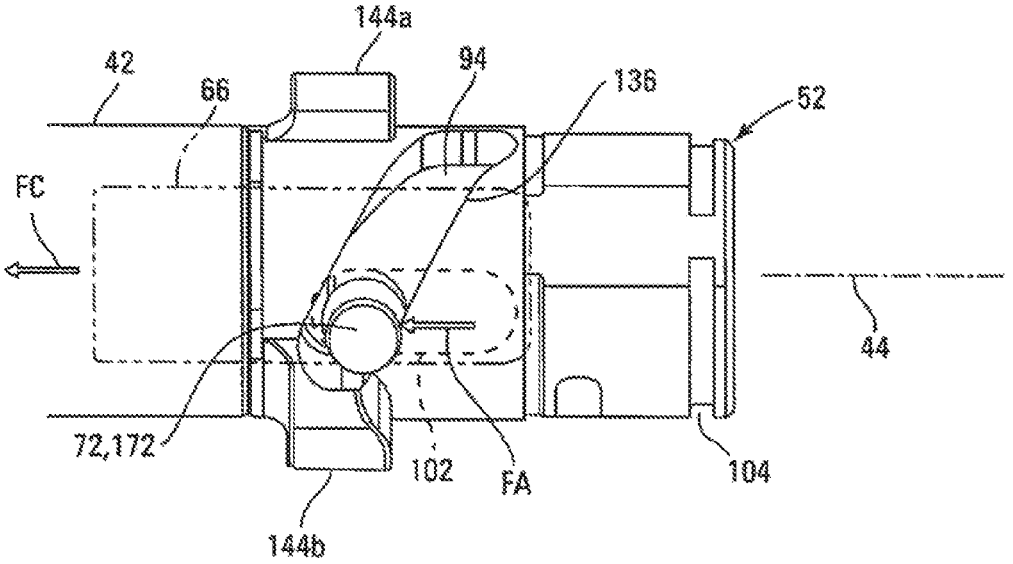

Referring to FIGS. 19 and 20, the cock-on-close aspect of the bolt assembly 38 is depicted in an embodiment of the disclosure. The cam cylinder 52, spring retainer 66, cam pin 72, and neck portion 94 of the main body 42 are depicted in assembly, with the longitudinal through-slot 102 being depicted as a hidden (dashed) line and the outline of the spring retainer 66 being depicted in phantom. In various embodiments, the handle 54 extends to the right side of the firearm 30, and the direction of rotation is downward to close. A downward (closing) rotation 262 of the handle 54 on the right side of the firearm 30 appears as an upward rotation 262 in FIGS. 19 and 20, which depict the assembly as viewed from the left side of the firearm 30.

The rotation 262 causes each of the cam slots 136, which are inclined relative to the central axis 44 because their spiral shape, to exert an axial force FA on the respective resident enlarged head portion 172 of cam pin 72, which causes the cam pin 72 to translate forward within the elongate through-slots 102 of the neck portion 94. The forward translation of the cam pin 72 causes the spring retainer 66 to exert an axial compressive force FC on the main spring 64. The main spring 64 is captured between the plunger 62 and the spring retainer 66 as the main spring 64 is compressed. The compressive force FC generated by compression of the main spring 64 is countered proximally by the inwardly extending retaining tab portions 222 of the housing, which are now in contact with the outwardly extending tab portions 144 of the cam cylinder 52 because of the rotation 262; thus, the force exerted proximally by the compressed spring 64 transfers from the spring retainer 66 to the cam pin 72 to the cam cylinder 52 to the housing. The compressive force FC is countered distally by the sear 256, which is coupled to a trigger 340 mounted to a casing 266, the casing 266 being mounted to the housing 200. Thus, the compression of the main spring 64 is countered ultimately by the housing 200.

Accordingly, the main spring 64 is compressed between the spring retainer 66 and the plunger 62 as the cam cylinder 52 is rotated into the closed position. In this configuration, the firearm is cocked, because when the sear 256 releases the trigger pin 70, the plunger 64 thrusts forward, causing the firing pin 74 to strike the cartridge, thereby discharging the firearm 30. Thus, the rotation of the handle from the open position to the closed position causes the compression of the main spring 64 and the subsequent cocking of the firearm 30. Thus, the bolt assembly 38 is a "cock-on-close" system.

Figure 21:
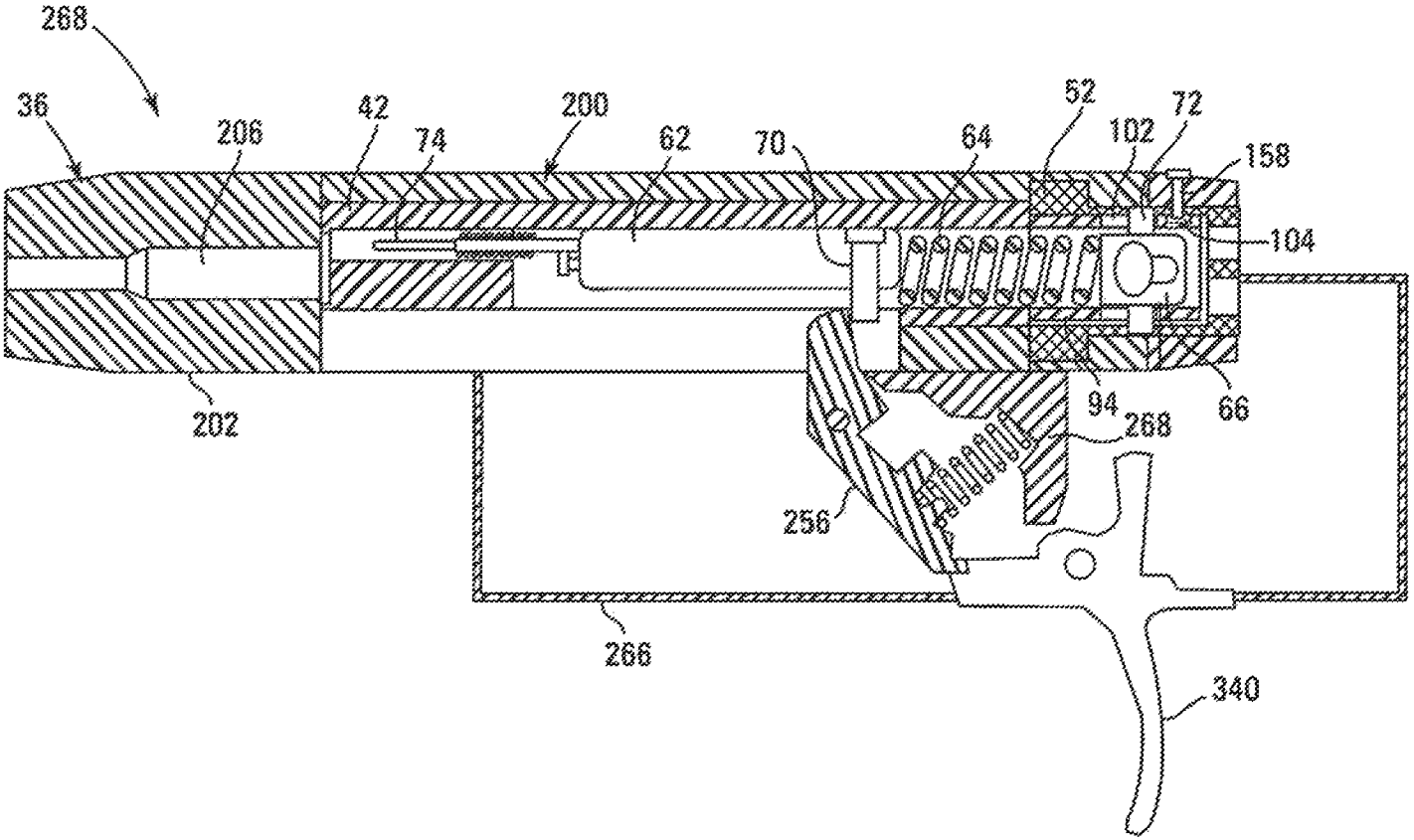
FIG. 21 is a sectional schematic of the assembly of FIG. 16 in an uncocked configuration.
Figure 22:
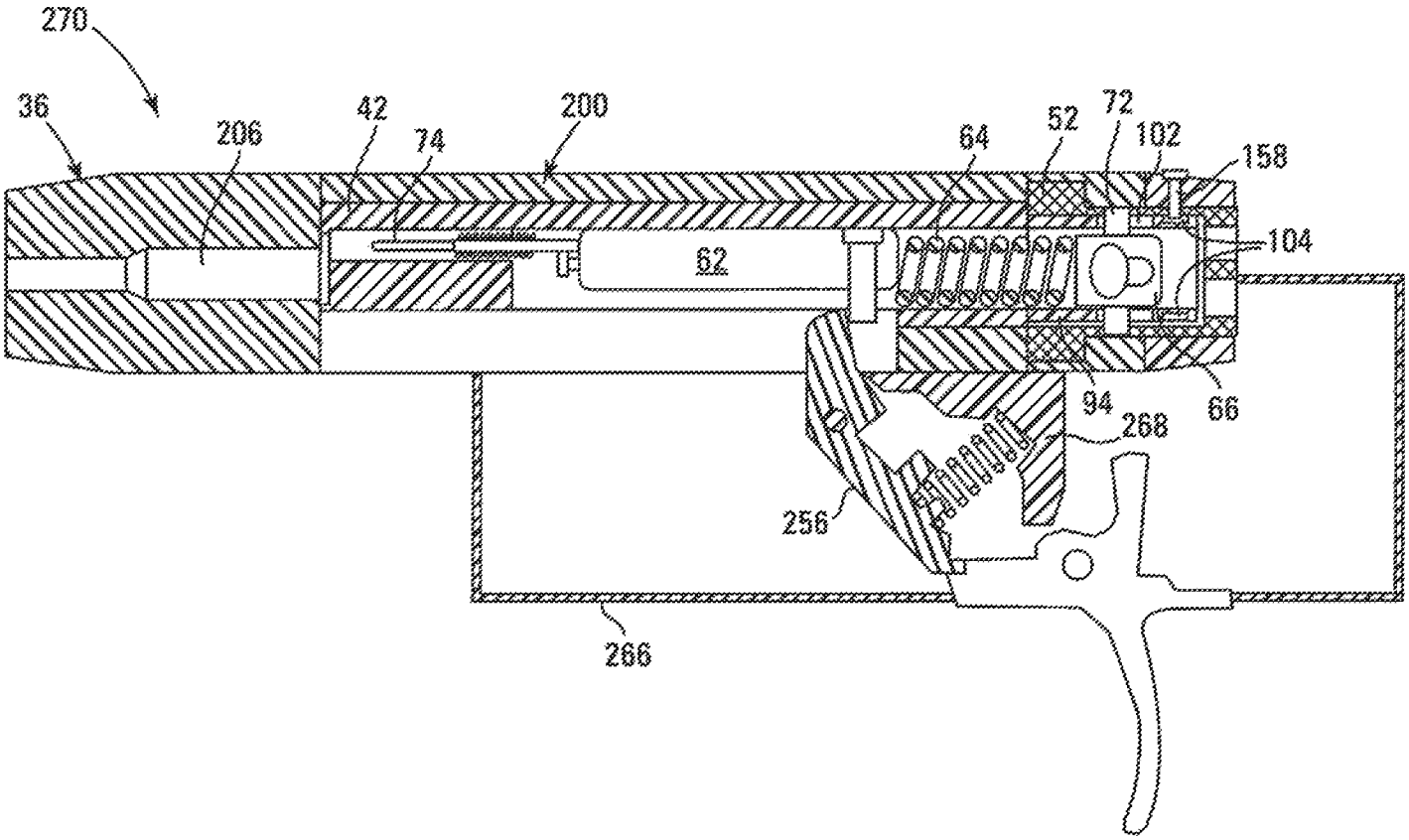
FIG. 22 is a sectional schematic of the assembly of FIG. 16 in a cocked configuration.
Figure 23:
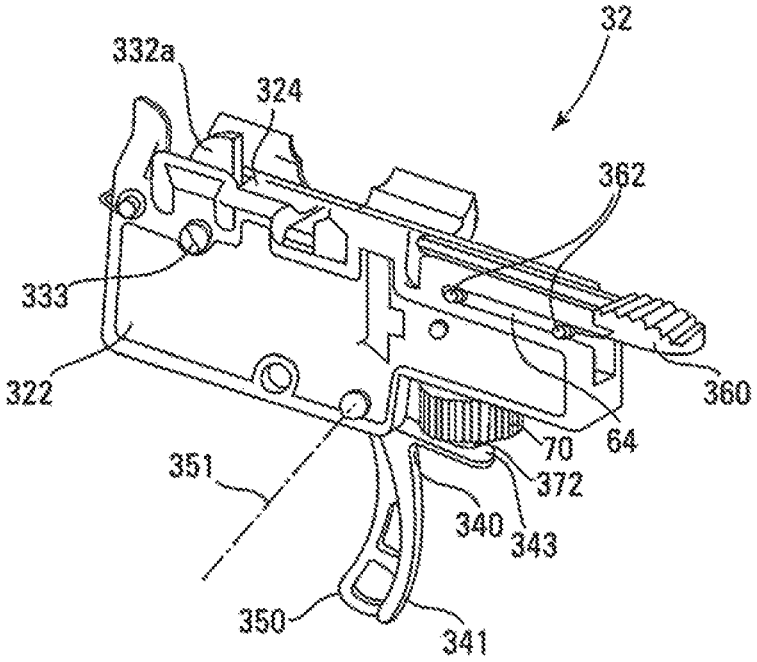
FIG. 23 is a side perspective view of the low creep, trigger assembly in an embodiment of the disclosure.
Figure 24:
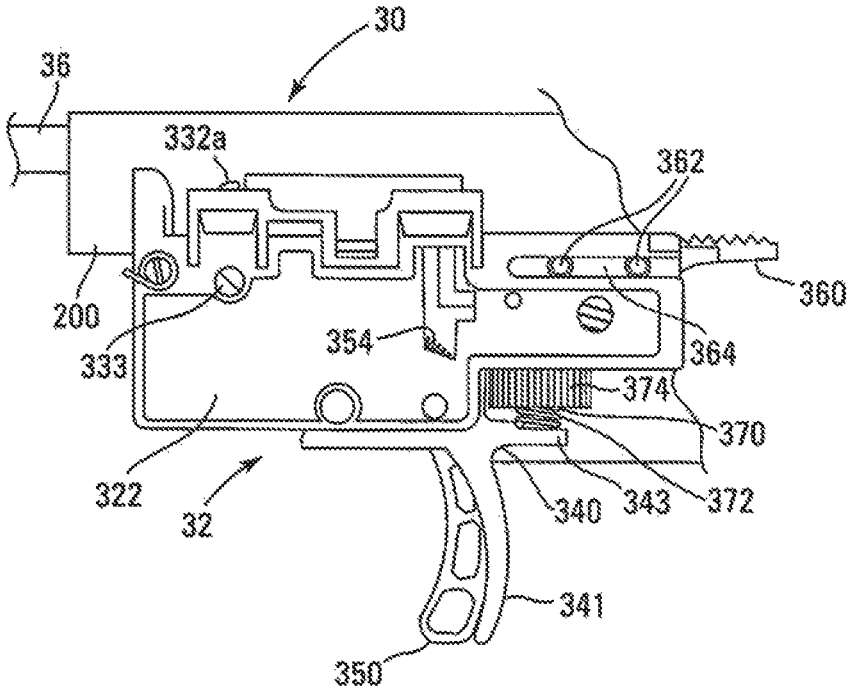
FIG. 24 is a side elevation view of the firearm with the trigger assembly of FIG. 23 in an installed configuration in an embodiment of the disclosure.

Referring to FIGS. 21 and 22, a schematic of an uncocked configuration 268 and a cocked configuration 270, respectively, are depicted in embodiments of the disclosure. The uncocked configuration 268 corresponds to the position of the cam cylinder 52 in FIG. 19, and the cocked configuration 270 corresponds to the position of the cam cylinder 52 in FIG. 20.

Referring to FIGS. 23 through 26, the trigger assembly 32 is depicted in an embodiment of the disclosure. The trigger assembly 32 includes the sear 256, a trigger 340, a stop lever 350, and a safety bar 360, all mounted within a casing 266, the casing 266 including a yoke structure 268. The trigger 340 comprises a finger pull portion 341, a step portion 342, a pull adjustment platform portion 343, and an upwardly extending safety projection 345. The step portion 342 includes an engagement face **342*a*, and can also include an upper face 347 and a lower face 342*c*. In one embodiment, the upper face 347 and/or the lower face 342*c* of the step portion 342 can be substantially planar and parallel to each other, with the engagement face 342*a* being substantially perpendicular to the upper and lower faces 347, 342*c***.

Figure 3:
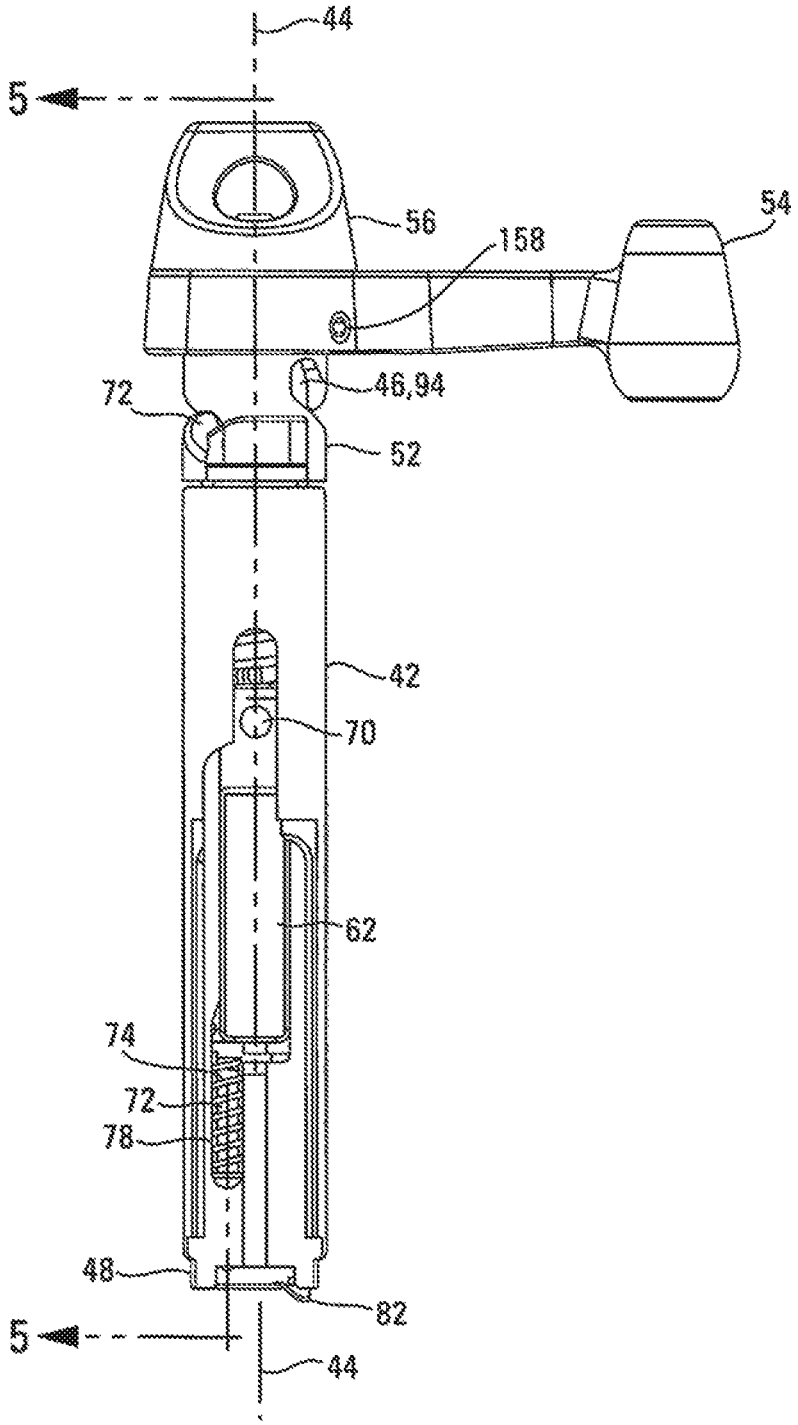

In various embodiments, the sear 256 includes an upper portion **256*a* and a lower portion 256*b*, the lower portion 256*b* including a projection 256*d*. The sear 256 is pivotally mounted about a pin 333 coupled to the casing 266 (FIG. 3). In one embodiment, the sear 256 extends downwardly and inwardly at an angle toward the trigger 340. A lower portion 256*b* of the sear 256 comprises a projection 256*c*, which engages the step portion 342 of the trigger 340. In the cocked configuration 270, the step portion 342 of the trigger is engaged with the sear 256**.

A stop lever 350, sharing a common pivot axis 351, i.e., coaxial, with the trigger 340 about pin 344, has a distally extending projection 352 (FIG. 6A), which engages a notch **256*d* that is formed in the lower portion 256*b* of the sear 256 to form an additional blocking position that prevents rotational movement of the sear 256. The stop lever 350 is selectively movable between a blocking position (FIG. 6A) and a non-blocking position (FIG. 6**B).

Figure 25:
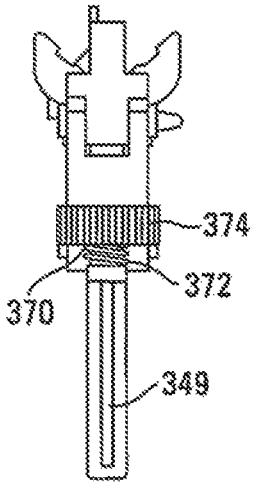
FIG. 25 is a rear elevation view of the trigger assembly of FIG. 23 illustrating the stop lever "nested" within the trigger.

In one embodiment, as best presented in FIG. 25, the stop lever 350 is nested within the trigger 340 in a slot 349 that extends therethrough. A spring 354 biases the stop lever 350 in the blocking position. When actuated by the shooter, the stop lever 350 is moved out of the blocking position and into the non-blocking position before the trigger 340 is depressed.

Figure 26A:
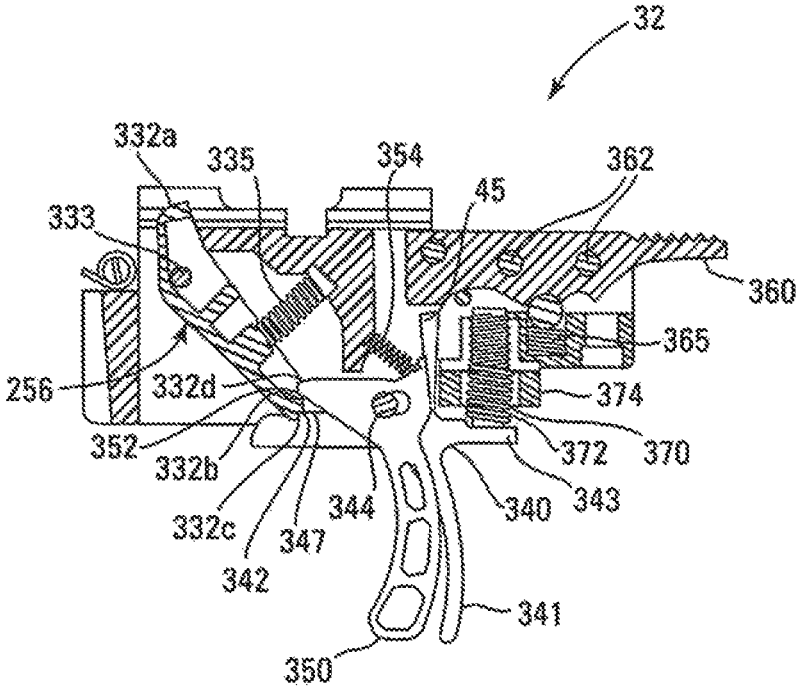
FIG. 26A is a side cross-sectional view of the low creep, trigger assembly of FIG. 24 is in a cocked configuration with a manual safety selectively engaged in an embodiment of the disclosure.
Figure 26B:
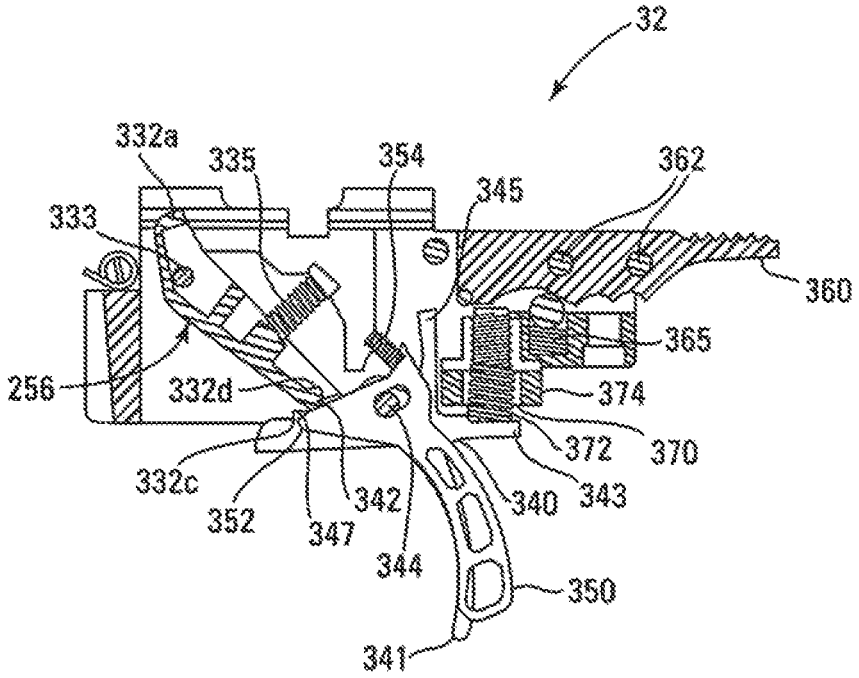
FIG. 26B is a side cross-sectional view of the low creep, trigger assembly of FIG. 24 illustrating in a discharged configuration with the manual safety selectively disengaged in an embodiment of the disclosure.

The trigger 340 is operatively coupled to a return spring 372 that biases the trigger 340 towards the cocked configuration (clockwise in FIGS. 26A and 26B). In the cocked configuration, the trigger 340 is in an engaged position, i.e., is in engagement with the sear 256.

In one embodiment, a trigger pull adjustment 370 comprises a post 376 that is threadably engaged with a thumbwheel 374. The post 376 can extend into the inner diameter of the return spring 372. The return spring 372 compressed between the thumbwheel 374 and the pull adjustment platform portion 343 of the trigger 340. In one embodiment, the thumbwheel 374 of the trigger pull adjustment 370 is accessible from outside the casing 266.

Functionally, the return spring 372 biases the main body of the sear 256 downwardly, which rotationally biases an upper portion 256*a* of the sear 256 to project into the cylindrical chamber 210 of the housing 200, and in the path of the trigger pin 70. The projection 345 of the trigger 340 cooperatively engages the safety bar 360 to prevent rotation of the trigger 340 when the safety bar 360 is selectively in the blocked position. When the safety bar 360 is positioned to enable rotation of the trigger 340, the engagement between the step portion 342 and the sear 256 prevents rotational movement (counterclockwise as viewed in FIG. 26A) of the sear 256 until the trigger 340 is actuated.

When rotation of the trigger 340 is fully enabled, actuation of the trigger 340 the trigger rotates about pin 344 (clockwise in FIG. 26B) to a disengaged position, causing the engagement face 342*a* of the trigger to disengage from the notch 256*d* of the sear 256. The main spring 64 which lowers the step portion 342, thus permitting the projection 256*c* to clear the engagement face 342*a* and slide along an upper face 347 of the trigger 340.

The degree of pre-loaded compression exerted on the return spring 372 is a function of the distance between the thumbwheel 374 and the pull adjustment platform portion 343. The pre-loaded compression of the return spring 372 can thus be varied by adjusting the position of the thumbwheel 374 on the post 376. The pre-loaded compression of the return spring 372 contributes the trigger pull force.

In operation, the user accesses the trigger pull adjustment 370 by snapping the trigger guard assembly 39 away from the receiver 34. The user can adjust the trigger pull adjustment 370 by rotating the thumbwheel 374 with a thumb and/or finger of his or her hand. In this way, the force required to actuate the trigger can be adjusted to the user's preference without having to remove the assembly 32 from the receiver/stock 34, and without need for external tools or accessories.

The trigger assembly 32 can includes the safety bar 360. The safety bar 360 is movable on two rollers 62 positioned within a slot 64 (FIG. 3) between an inward safety position (FIG. 6A) and an outward unblocked position (FIG. 6B). To prevent inadvertent movement of the safety bar 360, a spring-loaded 15 detent 65 holds the safety bar 360 in the inward safety position. As shown in FIG. 26A, when the safety bar 360 is in the safety position, it prevents the upwardly extending safety projection 345 of the trigger 340 from further upward movement, thus further preventing the trigger 340 from moving to the disengaged position.

In operation, the projection 256*c* engages the engagement face 342*a* of the step portion of the trigger 340 when the firearm is cocked. The distally extending projection 352 of the stop lever 350 extends slightly above the trigger 340 in the blocking position, poised to engage the notch 256*d* of the sear 256 should the sear 256 slip off the step portion 342 of the trigger 340. If the safety bar 360 is in the unblocked position (FIG. 6B) and the firearm sufficiently jarred to disengage the sear 256 from the step portion 342, the stop lever 350, through engagement with the notch 256*d* on the sear 256, captures the sear 256 and prevents release of the trigger pin 70. Therefore, the stop lever 350 prevents the firearm 30 from accidentally discharging even when the safety bar 360 is in an unblocked position.

To intentionally discharge the firearm 30, the shooter first loads and cocks firearm 30 and moves the safety bar 360 to the unblocked position. The shooter then depresses the stop lever 350 extending forward of the finger pull portion 341 of the trigger 340 with the shooter's trigger finger by a simple squeezing motion. Before the shooter's trigger finger engages the finger pull portion 341 of the trigger 340, the distally extending projection 352 of the stop lever 350 rotates away from the blocking position into the non-blocking position. As the shooter continues to squeeze the trigger 340, the resultant pivoting motion of the trigger 340 causes the projection 256*c* of the sear to disengage from the engagement face 342*a* of the step portion 342, subsequently discharging the firearm 30. Because the stop lever 350 is no longer in a blocking position, the trigger 340 is able to continue through its full firing motion, thus releasing the sear 256 for pivotal movement.

While a sear return spring 335 keeps the sear 256 biased in the same position as shown in FIG. 26A, the energy exerted on the upper portion 256*a* of the sear 256 by the main spring 64 is sufficient to overcome the energy of the sear return spring 335, causing the sear 256 to rotate about pivot 333 and the upper portion 256*a* to rotate downwardly. The release of the main spring 64 thrusts the firing pin 74 forward to strike the cartridge and discharge the firearm 30. When the shooter releases the trigger 340, the compression spring 372 of the trigger pull adjustment 370 then biases the trigger 340 back toward its initial position. When the bolt assembly 32 is opened and retracted, the sear 256 is returned to the cocking position by the sear return spring 335.

Figure 27A:
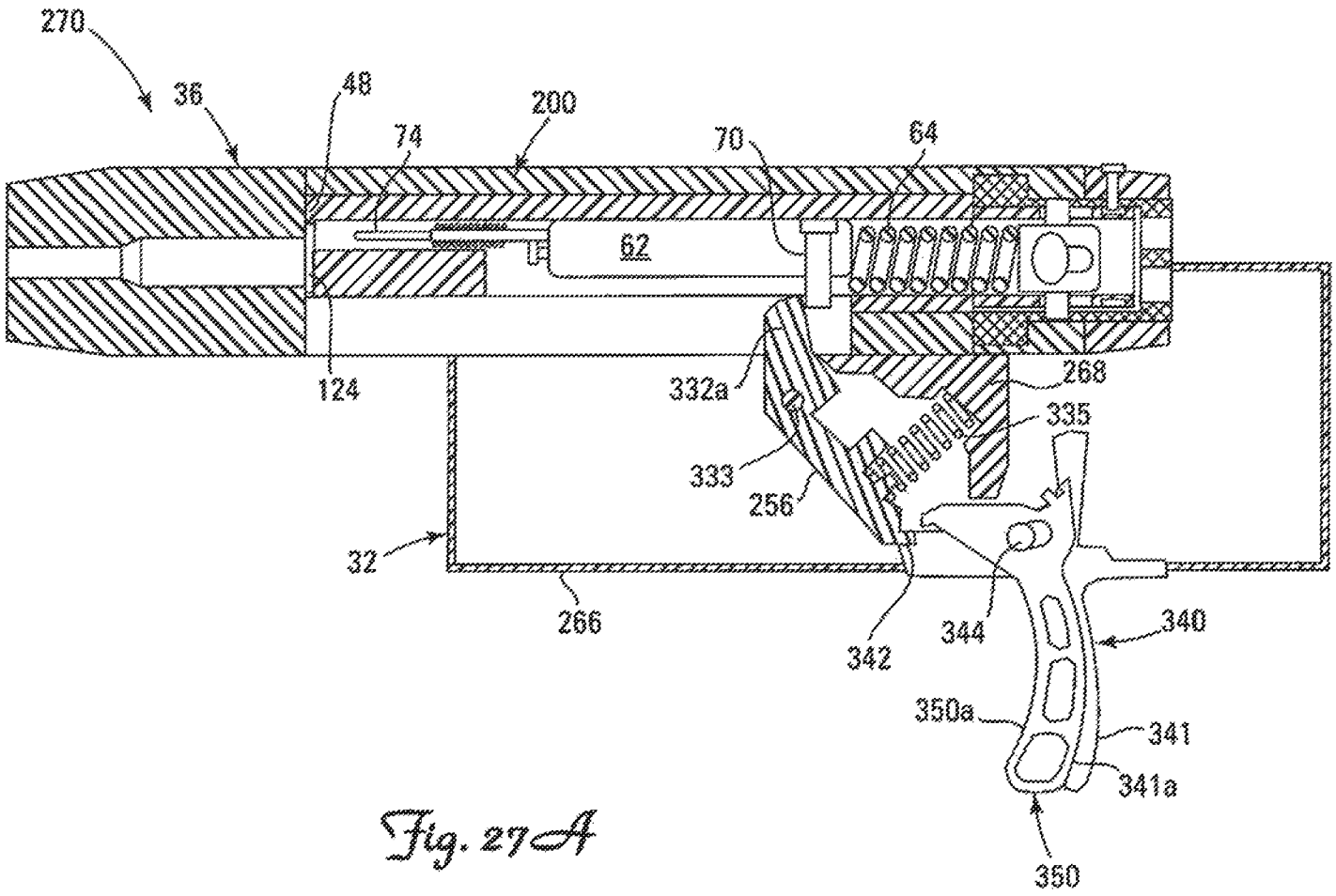
FIG. 27A is a schematic depiction of the trigger assembly in a cocked configuration in an embodiment of the disclosure.
Figure 27B:
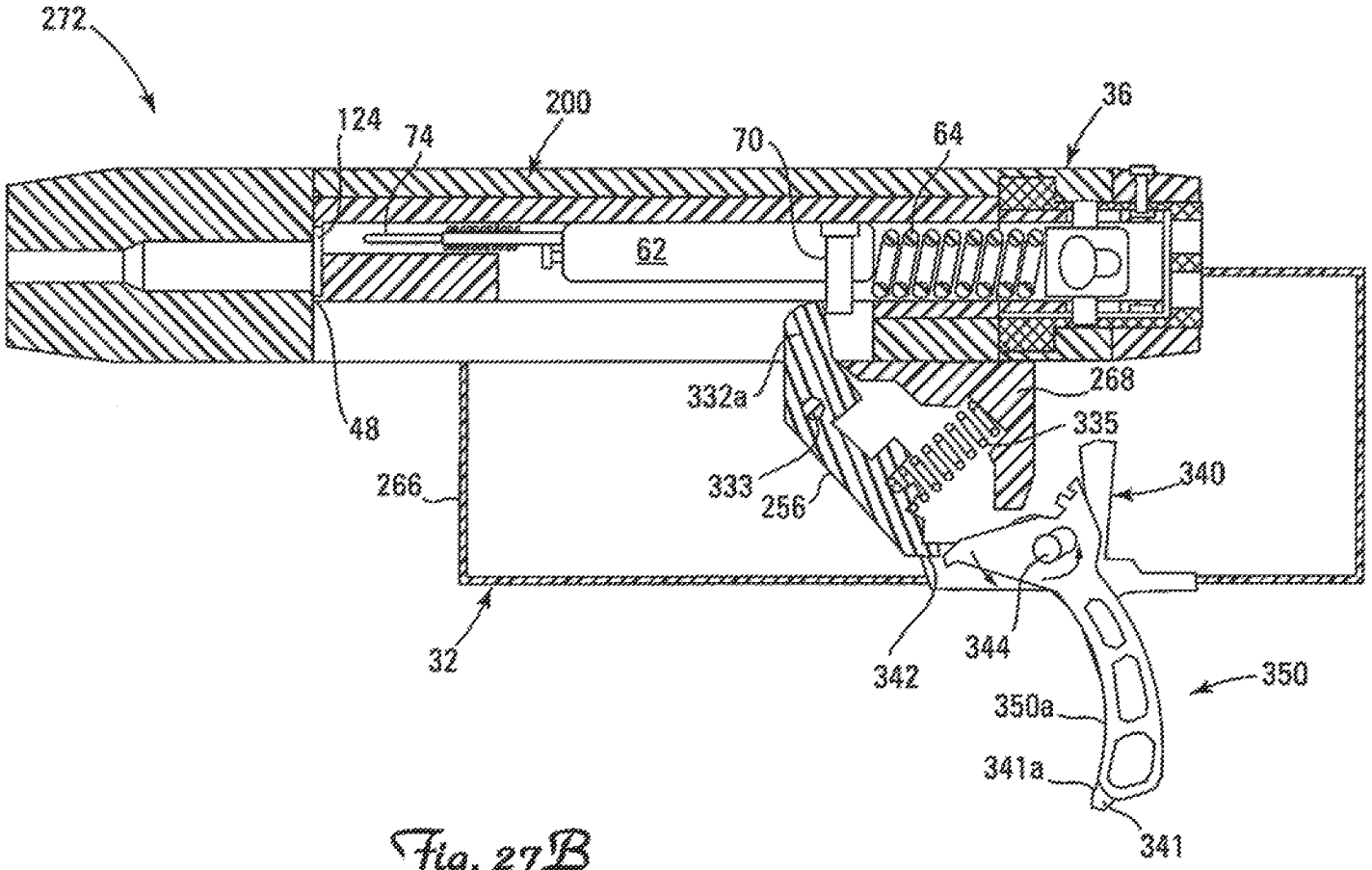
FIG. 27B is a schematic depiction of the trigger assembly in a discharge enabled configuration in an embodiment of the disclosure.
Figure 27C:
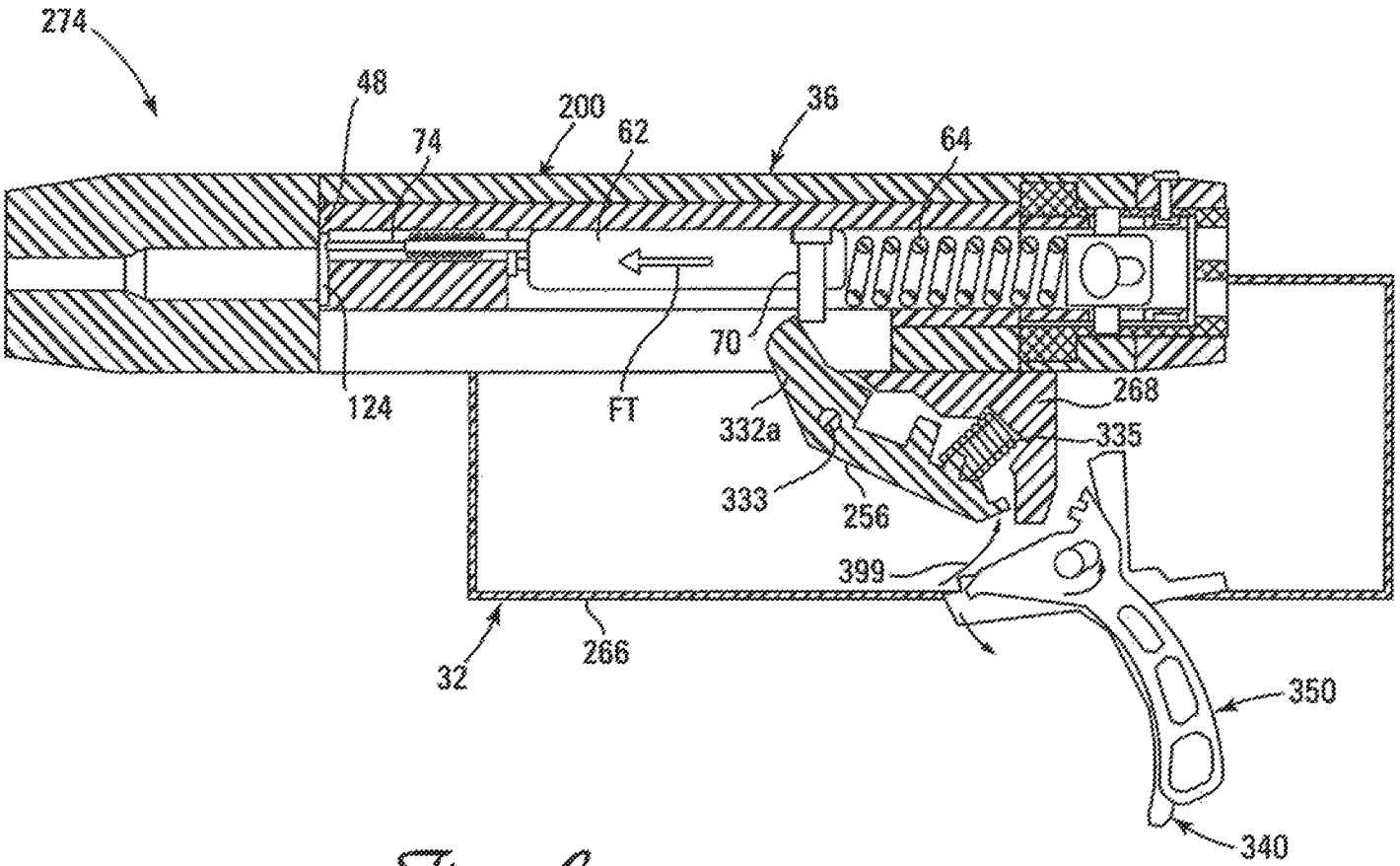
FIG. 27C is a schematic depiction of the trigger assembly in a triggered configuration in an embodiment of the disclosure.

Referring to FIGS. 27A through 27C, the bolt assembly 38 and housing 200 in combination with the trigger assembly 32 are depicted in progression from the cocked configuration 270 to a discharge-enabled configuration 272 to a discharged configuration 272 of depicted, respectively, in an embodiment of the disclosure. In the cocked configuration 270 (FIG. 27A), the sear 256 is maintained in equilibrium, as described above. In the discharge-enabled configuration 272 (FIG. 27B), the stop lever 350 is rotated away from the blocking position, also described above. It is noted that, in some embodiments, as a distal edge 350*a* of the stop lever 350 becomes flush with a distal edge 341*a* of the finger pull portion 341 of the trigger 340, the stop lever 350 is not completely out of a the rotational path 399 of the sear 256; this is because the stop lever 350 will continue to rotate out of the rotational path 399 of the sear 256, so when the trigger 340 releases the sear 256, the stop lever 350 is out of the rotational path 399 of the sear 256.

In the triggered configuration 274 (FIG. 27C), the trigger 340 and stop lever 350 are clear of the rotational path 399 of the sear 256 about pin 333. The distal thrust FT exerted by the main spring 64 causes the plunger 62 to thrust forward, pushing the firing pin 74 forward. The forward thrust is terminated when the stop portion 182 collides with the distal boundary 92 of the center bore 68. The firing pin 74 is dimensioned so as to encroach into the recess 124 formed in the distal end 48 of the main body 42, thereby discharging any live cartridge mounted therein.

Figure 28:
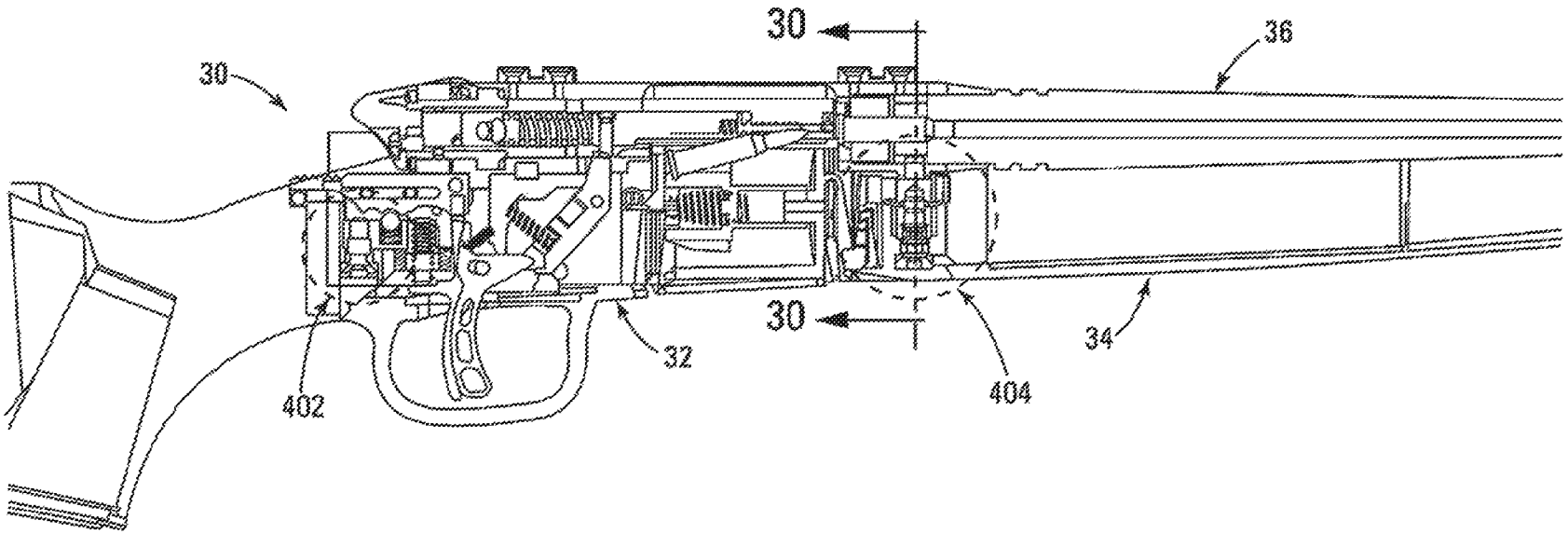
FIG. 28 is a partial sectional elevation view of a mounting system for coupling the barrel and trigger assemblies in an embodiment of the disclosure.
Figure 29:
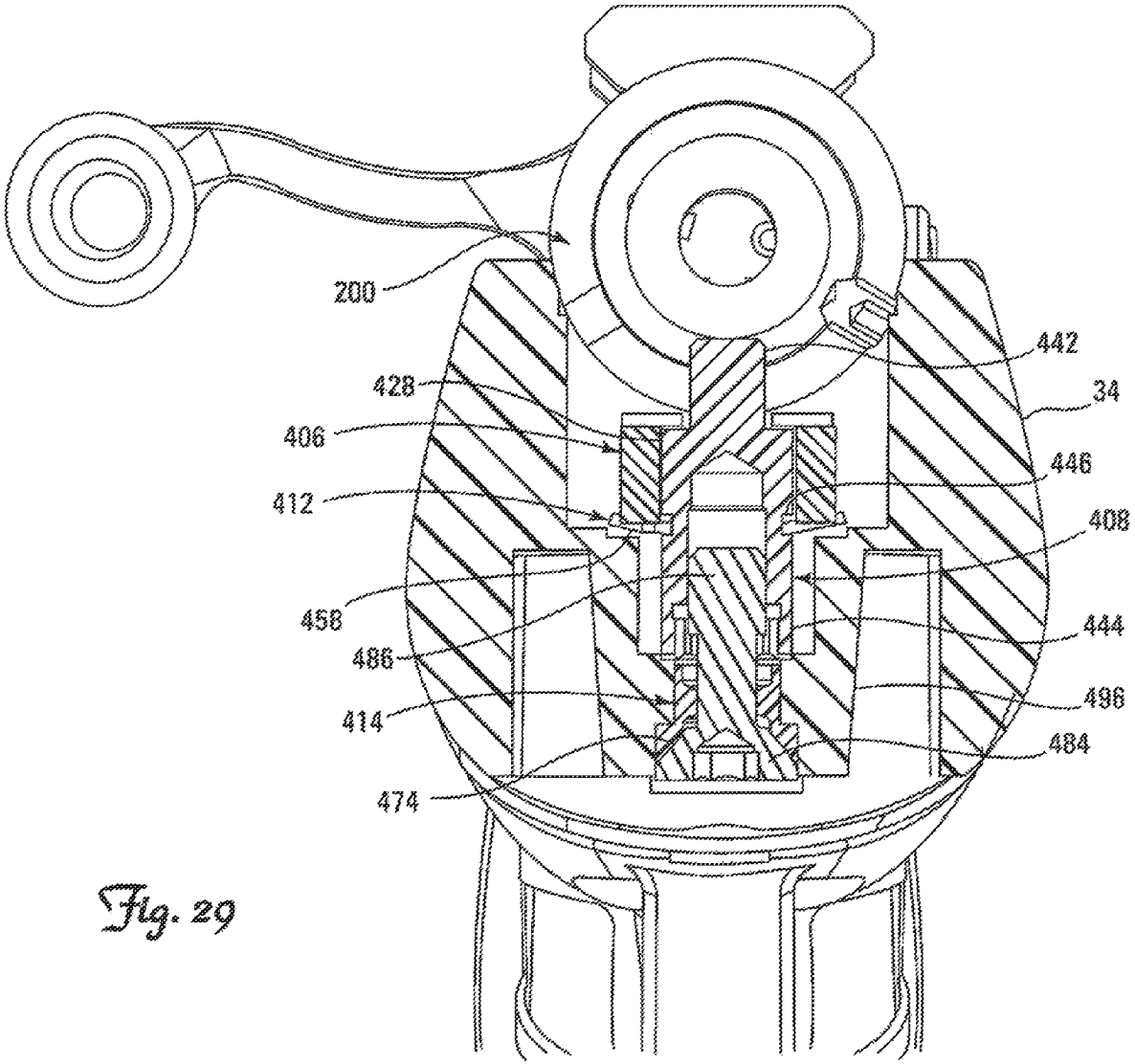
FIG. 29 is an enlarged, sectional view of the mounting system of FIG. 28.
Figure 30:
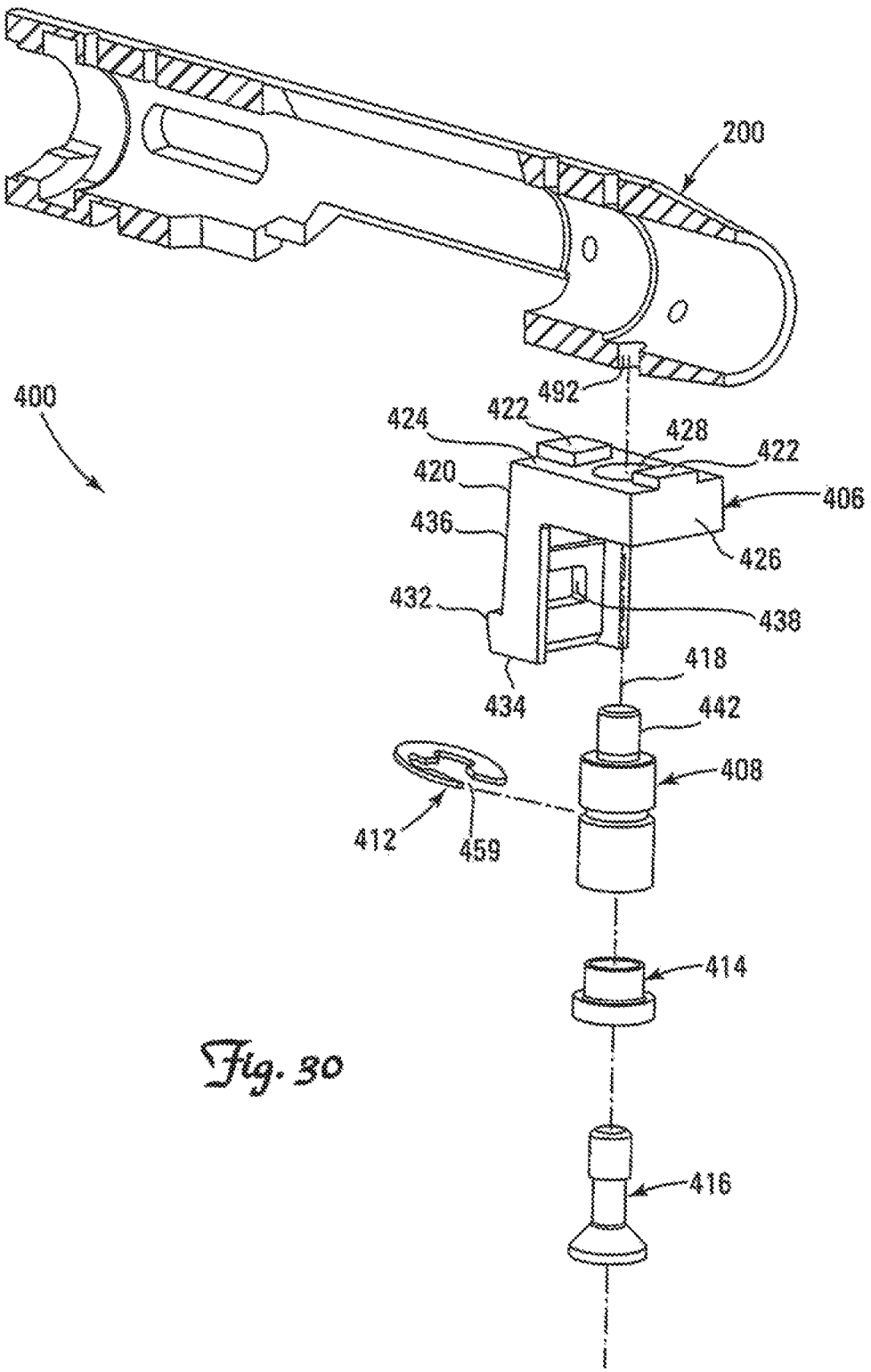
FIG. 30 is an exploded view of the mounting system of FIG. 28.

Referring to FIGS. 28 through 30, a mounting system 400 for coupling the barrel and trigger assemblies 36 and 32 to the receiver 34 is depicted in an embodiment of the disclosure. In one embodiment, the receiver 34 is mounted at two locations: a proximal portion 402 of the trigger assembly 32, and a distal portion 404 of the housing 200. Following is a discussion of the mounting system 400 as coupled to the distal portion 404 of the housing 200. Those of skill in the art will recognize that the same aspects and principles can be utilized for mounting of the receiver 34 to the proximal portion 402 of the trigger assembly 32 as well.

As applied to the distal portion 404 of the housing 200, the mounting system 400 includes a front magazine mount 406, a barrel locking stud 408, a retaining clip washer 412, a flat head pillar 414, and a clamping screw 416, all mounted about a mounting axis 418 that is substantially perpendicular to the central axis 44. In one embodiment, the front magazine mount 406 comprises an inverted L-shaped bracket 420 having features 422 on a top face 424 of a distally extending leg 426 thereof. The distally extending leg 426 can also include structure defining a through aperture 428 that passes therethrough about the mounting axis 418. In one embodiment, the L-shaped bracket includes a barb portion 432 formed on an end 434 of a downward extending leg 436, the barb portion 432 being opposite the distally extending leg 426. The downward extending leg 436 can also define a through-aperture 438.

Functionally, in various embodiments, the barb portion 432 engages a clip on a magazine (not depicted). The through-aperture 438 can accommodate a detent 439 on the trigger guard 39 for quick connection/disconnection.

Figure 30A:
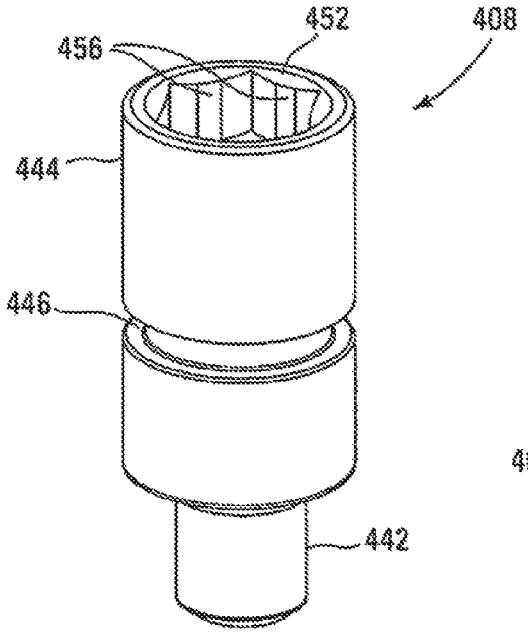
FIGS. 30A through 30E are various views of components of the mounting system of FIG. 28 in embodiments of the disclosure.
Figure 30B:
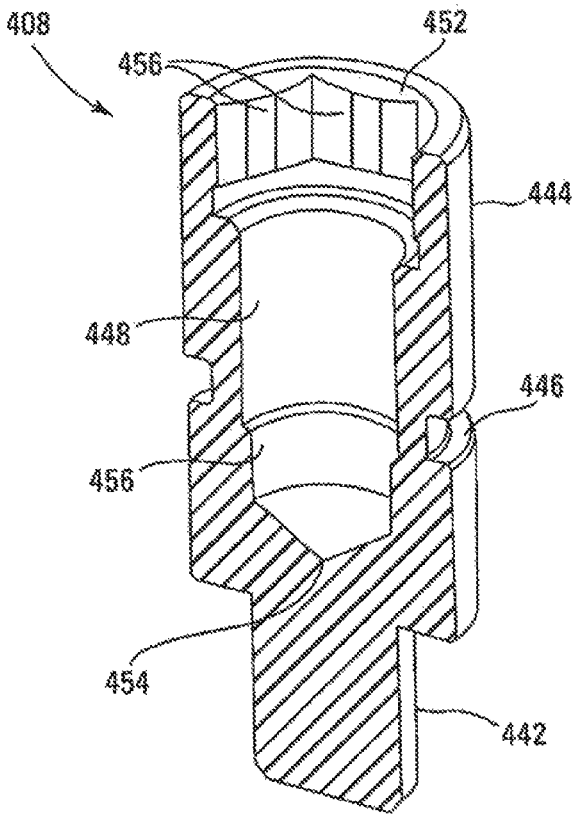

A threaded female fastener with a male threaded portion, a barrel locking stud 408, which is depicted in isolation in FIGS. 30A and 30B, includes an externally threaded portion 442 that depends from a head portion 444. The head portion 444 can include structure that defines an external tangential channel 446 and an interior cavity 448. The interior cavity 448 define an opening 452 and a bottom extremity 454. In one embodiment, the interior cavity defines internal flats 456 proximate the opening 452, and a female threaded portion 456 proximate the bottom extremity 454.

The retaining clip washer 412 can be of a beveled profile 458 (FIG. 29) to provide spring loading when compressed, and can also include an access slot 459 sized to resiliently clip over the inner diameter of the tangential channel 446 of the barrel locking stud 408.

Figure 30C:
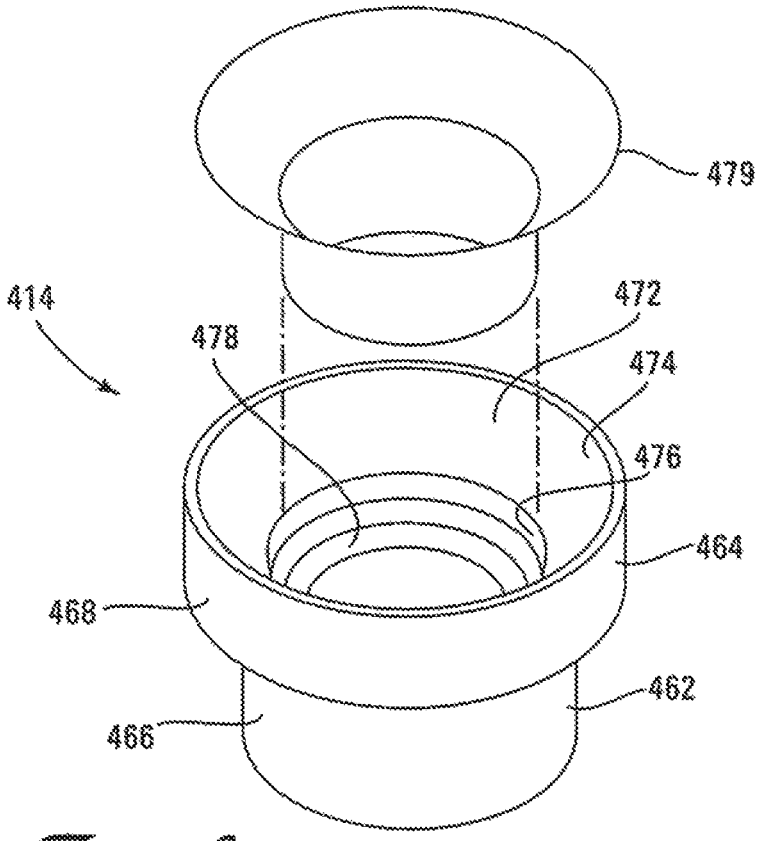
Figure 30D:
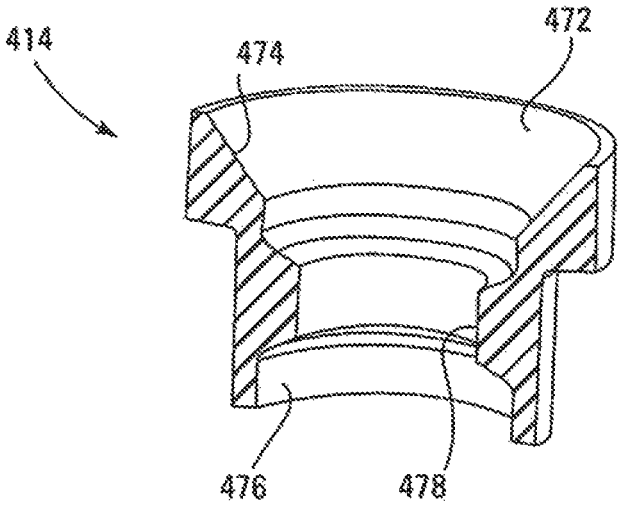

A bushing, configured as a flat head pillar 414, which is depicted in isolation in FIGS. 30C and 30D, includes a body portion 462 and a flange portion 464, both of which can define substantially cylindrical outer surfaces 466 and 468, respectively. In one embodiment, an internal surface 472 of the flange portion 464 defines a countersink geometry 474. Also, an internal surface 476 of the body portion 462 can define a reduced diameter orifice 478. The pillar may be formed of a polymer or metal or a composite. For example a thin metal piece with a tapered section and a tubular section can add strength to a polymer pillar where engaged by the screw as illustrated in FIG. 30C. Similarly, metal threading can be added to a hole in the opening of the portion of the pillar near the tapered portion.

Figure 30E:
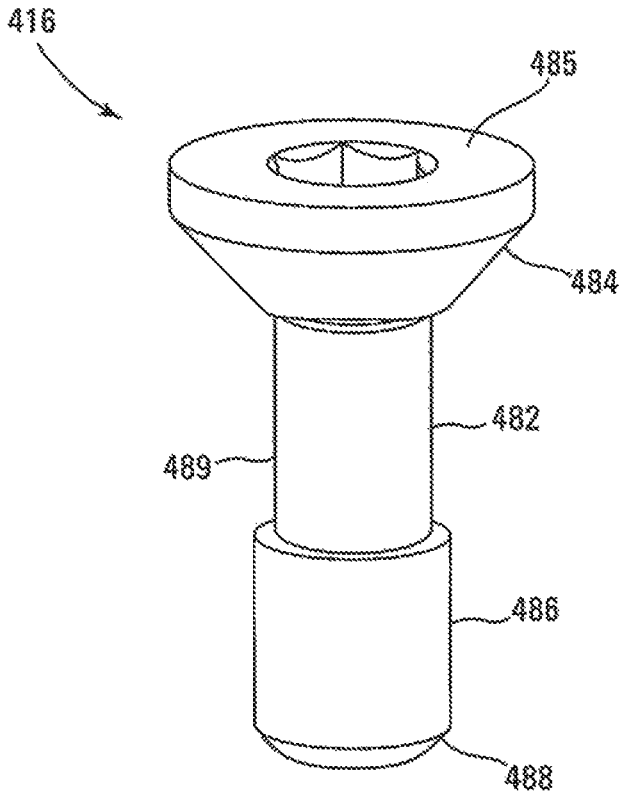

The clamping screw 416, which is depicted in isolation in FIG. 30E, includes a shaft portion 482 having a countersink head 484 at a first end 485 and a male threaded portion 486 at a second end 488. In one embodiment, an unthreaded portion 489 of the shaft portion 482 is of reduced diameter relative to the outer diameter of the male threaded portion 486.

In assembly, the through-aperture 428 of the front magazine mount 406 is aligned with a threaded mounting hole 492 on the underside of the housing 200 (FIG. 18). The features 422 of the front magazine mount 406 are aligned with and inserted into recesses 494 that are formed on the underside of the housing 200 (FIG. 18). The barrel locking stud 408 is fed through the through-aperture 428 and the externally threaded portion 442 threadably engaged within the threaded mounting hole 492. (Alternatively, the barrel locking stud 408 can first be mounted to the threaded mounting hole 492, and the through-aperture 428 slid over the barrel locking stud 408 to engage the features 422 within the recesses 494.) Mounting of the barrel locking stud 408 to the threaded mounting hole 492 can be performed, for example, with a hex wrench that engages the internal flats 456 of the barrel locking stud 408. The retaining clip washer 412 can be clipped onto the tangential channel 446 of the barrel locking stud 408.

In one embodiment, the flat head pillar 414 is mounted within a boss 496 (FIG. 29) that is formed on the receiver 34. The flat head pillar 414 can be dimensioned to provide a press fit within the boss 496.

The barrel assembly 36 is disposed in the receiver 34 so that the barrel locking stud 408 and the flat head pillar 414 are in alignment along the mounting axis 418. The male threaded portion 486 of the clamping screw 416 is then engaged within the female threaded portion 456 of the barrel locking stud 408 and tightened down, thereby securing the barrel assembly 36 to the receiver 36. In one embodiment, the retaining clip washer 412 is compressed between the receiver 34 and the front magazine mount 406. If the retaining clip washer 412 is of the beveled profile 458, compression causes the beveled profile 458 to flatten out, thereby providing a spring loading between the front magazine mount 406 and the receiver 34.

In one embodiment, the male threaded portion 486 of the clamping screw 416 can be dimensioned for slight interference with the reduced diameter orifice 478, thereby providing a creating high friction with the male threaded portion 486 as it is inserted through the reduced diameter orifice 478. The reduced diameter of the shaft portion 482 enables free rotation of the clamping screw 416 the male threaded portion 486 is inserted through and clears the reduced diameter orifice 478. Accordingly, the reduced diameter orifice 478 helps retain the clamping screw 416 within the receiver 34 when the barrel assembly 36 is disengaged, preventing loss of clamping screw 416, for example, during servicing in the field.

In embodiments, tightening of the screw 416 axially, due to the cooperating tapered surfaces of the screw 416 and pillar 414, exerts a force having an axial component as well as a radial component. Thus, positive reactive forces are exerted on the receiver 34, enhancing the integrity of the engagement between the pillar 414, the screw 416, and the receiver 34. Utilization of this system has been shown to provide greater stability in the connection between the connected components providing for a more robust firearm. This connection system is applicable to other firearms, particularly rifles. The connection system is suitable for polymer stocks and wood stocks. In certain embodiments, compression of the flat head pillar 414 compresses and radially expands the flat head pillar, further enhancing the integrity of the engagement between the pillar 414, the screw 416, and the receiver 34. In one embodiment, the flat head pillar 414 is fabricated from a metal. In other embodiments, the flat head pillar 414 is fabricated from a resilient polymer, which can enhance the expansion under the compressive load of the clamping screw 416 for tighter coupling to the boss 496 of the receiver.

Certain modifications and improvements will occur to those skilled in the art upon a reading of the foregoing description. By way of example, while the firearms set out in the specification are bolt action rifles, the present embodiments can be adapted to similar firearms including pump and lever actions, as well as both pistols and long guns. Also, while the present disclosure refers to "firearms," it should be understood that the embodiments disclosed herein can also be adapted for air guns, crossbows and similar arms. It should be understood that all such modifications and improvements have been deleted herein for the sake of conciseness and readability but are properly within the scope of the claims.

Like reference characters designate like or corresponding parts throughout the several views. Also, it is to be understood that such terms as "forward," "rearward," "left," "right," "upwardly," "downwardly," and the like are words of convenience and are not to be construed as limiting terms.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant art will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A bolt action firearm, comprising:

a bolt assembly including:

a main body defining a central bore along a central axis and an elongate through-slot that passes through said main body;

a cam cylinder mounted to said main body, said cam cylinder defining a spiral-shaped slot that passes through said cam cylinder;

a handle portion coupled to said cam cylinder; and a cam pin that extends perpendicular to said central axis, through said elongate through-slot of said main body, and through said spiral-shaped slot of said cam cylinder, wherein rotation of said bolt assembly about said central axis with said handle portion causes said spiral slot of said cam cylinder to rotate about and exert an axial force that is parallel to said central axis against said cam pin, which causes a translation of said cam pin within said elongate through-slot of said main body.

2. The bolt action firearm of claim 1, comprising:

a spring retainer coupled to said cam pin and slidably engaged within said central bore; and a main spring disposed distal to and in contact with said spring retainer, wherein rotation of said bolt assembly from an open position to a closed position causes said translation of said cam pin to exert a force on said spring retainer in a distal direction, which causes said spring retainer to move in said distal direction to apply a compressive force on said main spring.

3. The bolt action firearm of claim 1, wherein said main body includes a neck portion that defines said elongate through-slot.

4. The bolt action firearm of claim 3, wherein said cam cylinder is mounted to an external surface of said neck portion.

5. The bolt action firearm of claim 1, comprising:

a trigger assembly; and a barrel operatively coupled with said trigger assembly, wherein said bolt assembly is operatively coupled to said trigger assembly and said barrel.

6. The bolt action firearm of claim 5, comprising a housing attached to a proximal end of said barrel, said housing defining an actuation axis, said bolt assembly being disposed within said housing so that said central axis of said bolt assembly is substantially concentric with said actuation axis, said bolt assembly being translatable along said actuation axis.

7. The bolt action firearm of claim 6, wherein:

said housing includes a plurality of inwardly extending retaining tab portions disposed at a proximal end thereof, each of said inwardly extending retaining tab portions including a distal face; and said cam cylinder of said bolt assembly includes a plurality of outwardly extending tab portions, each of said outwardly extending tab portions including a proximal face, wherein rotation of said bolt assembly from an open position to a closed position causes each said proximal face of said plurality of outwardly extending tab portions to rotate into contact with said distal face of a corresponding one said plurality of inwardly extending retaining tab portions of said housing to secure said bolt assembly within said housing.

8. The bolt action firearm of claim 7, wherein said plurality of inwardly extending retaining tab portions include lead-in surfaces.

9. The bolt action firearm of claim 7, wherein said plurality of outwardly extending tab portions include lead-in surfaces.

10. A cock-on-close bolt action firearm, comprising:

a bolt assembly including:

a main body defining central bore along a central axis and an elongate through-slot that passes through said main body;

a cam cylinder mounted to said main body, said cam cylinder defining a spiral-shaped slot that passes through said cam cylinder;

a spring retainer slidably engaged within said central bore;

a cam pin disposed in said spring retainer, said cam pin extending perpendicular to said central axis, through said elongate through-slot of said main body, and through said spiral-shaped slot of said cam cylinder; and a main spring disposed distal to and in contact with said spring retainer, wherein rotation of said bolt assembly about said central axis from an open position to a closed position causes said cam to exert a force on said cam pin in a distal direction, which causes said cam pin and said spring retainer to move in said distal direction to apply a compressive force on said main spring.

11. The cock-on-close bolt action firearm of claim 10, wherein said main body includes a neck portion that defines said elongate through-slot.

12. The bolt action firearm of claim 11, wherein said cam cylinder is mounted to an external surface of said neck portion.

13. A bolt action firearm, comprising:

a bolt assembly including:

a main body defining a central bore along a central axis;

a cam cylinder mounted to said main body, said cam cylinder defining a spiral-shaped slot;

a handle portion coupled to said cam cylinder;

a cam follower that engages said spiral-shaped slot of said cam cylinder;

a spring retainer coupled to said cam follower and slidably engaged within said central bore; and a main spring disposed distal to and in contact with said spring retainer, wherein rotation of said bolt assembly about said central axis with said handle portion causes said spiral slot of said cam cylinder to rotate about and exert an axial force that is parallel to said central axis against said cam follower, which causes a translation of said cam follower and said spring retainer.

14. The bolt action firearm of claim 13, wherein rotation of said bolt assembly from an open position to a closed position causes said translation of said cam follower and said spring retainer to exert a force on said spring retainer in a distal direction, which causes said spring retainer to move in said distal direction to apply a compressive force on said main spring.

15. The bolt action firearm of claim 13, wherein said spiral-shaped slot that passes through said cam cylinder.

16. The bolt action firearm of claim 13, wherein said cam follower is a cam pin.

17. The bolt action firearm of claim 16, wherein:

said main body defines an elongate through-slot that extends parallel to said central axis; and said cam pin engages said elongate through-slot and said spiral-shaped slot.

18. The bolt action firearm of claim 17, wherein said elongate through-slot passes through said main body, said cam pin passing through said elongate through-slot.

19. The bolt action firearm of claim 17, wherein said spiral-shaped slot passes through a wall of said cam cylinder, said cam pin passing through said spiral-shaped slot.

* * * * *